US006013402A

United States Patent [19]

Kanbayashi et al.

[11] Patent Number: 6,013,402

[45] Date of Patent: Jan. 11, 2000

[54] COLOR TONER AND IMAGE FORMING METHOD

[75] Inventors: Makoto Kanbayashi, Shizuoka-ken; Masaaki Taya, Mishima; Wakashi Iida, Numazu; Tetsuya Ida, Mishima, all of Japan

[73] Assignee: Canon Kabushiki Kaisha, Tokyo, Japan

[21] Appl. No.: 09/215,325

[22] Filed: Dec. 18, 1998

[30] Foreign Application Priority Data

Dec. 18, 1997 [JP] Japan ..... 9-348751

[51] Int. Cl.[7] ..... G03G 13/16; G03G 9/09

[52] U.S. Cl. ..... 430/45; 430/126

[58] Field of Search ..... 430/45, 111, 125, 430/126

[56] References Cited

U.S. PATENT DOCUMENTS

| | | | |
|---|---|---|---|
| 5,202,731 | 4/1993 | Tanikawa et al. | 355/251 |
| 5,324,612 | 6/1994 | Maeda et al. | 430/109 |
| 5,348,829 | 9/1994 | Uchiyama et al. | 430/106.6 |
| 5,637,432 | 6/1997 | Okado et al. | 430/110 |

FOREIGN PATENT DOCUMENTS

| | | |
|---|---|---|
| 0541113 | 5/1993 | European Pat. Off. . |
| 0784237 | 7/1997 | European Pat. Off. . |

OTHER PUBLICATIONS

Database WPI, Section Ch, Week 9408, Derwent Pub., XP–002098182 (1994).

*Primary Examiner*—John Goodrow

*Attorney, Agent, or Firm*—Fitzpatrick, Cella, Harper & Sctino

[57] ABSTRACT

A color toner has (i) color toner particles containing at least a binder resin and a colorant and (ii) an external additive. The color toner has a weight-average particle diameter of 5 to 8 $\mu$m and a number-average particle diameter of 4.5 to 7.5 $\mu$m, and contains 5 to 40% by number of particles having a particle diameter of 4 $\mu$m or less in the number distribution of the color toner and 7% by volume or less of particles having a particle diameter of 10.08 $\mu$m or more in the volume distribution of the color toner. The inorganic powder selected from the group consisting of a strontium titanate powder, a cerium oxide powder and a calcium titanate powder, and a hydrophobic fine alumina powder are externally added to the color toner particles as the external additives, the inorganic powder has a longitudinal average particle diameter of 0.2 to 2 $\mu$m, and the hydrophobic fine alumina powder has a longitudinal average particle diameter of 0.005 to 0.1 $\mu$m. The binder resin is a polyester resin crosslinked by a crosslinking agent. The color toner particles contain 0 to 20 mg/lg of a chloroform insoluble matter. The color toner has a storage modulus ($G'_{130}$) of $2\times10^3$ to $2\times10^4$ [dyn/cm$^2$] at a temperature of 130° C. and a storage modulus ($G'_{170}$) of $5\times10^3$ to $5\times10^4$ [dyn/cm$^2$] at a temperature of 170° C., and a value of $G'_{170}/G'_{130}$ is in the range of 0.25 to 10.

43 Claims, 3 Drawing Sheets

COLOR TONER AND IMAGE FORMING METHOD

BACKGROUND OF THE INVENTION

1. Field of the Invention

The present invention relates to a color toner for the development of an electrostatic charge image in image formation methods such as electronic photography and static recording; a color toner which can be used in an image forming method of a toner jet system; and an image forming method.

2. Related Background Art

Usually, in the case of a system in which transfer material is loaded on a transfer drum, a full color image can be formed as follows. A photosensitive member on a photosensitive drum is evenly electrified by using a primary electrifier, and an image is exposed with laser rays modulated with, for example, a yellow image signal of a manuscript to form a static charge image on the photosensitive drum. The static charge image is developed with a yellow developing apparatus having yellow toner to form a yellow toner image. Subsequently, the yellow toner image developed on the photosensitive drum is transferred to a carried transfer material by a transfer electrifier.

On the other hand, the photosensitive drum, in which said static charged image has been developed, is diselectrified by an electrifier for diselectrification, cleaned by a cleaning means, and electrified again by the primary electrifier, a cyan image, for example, is formed and the cyan toner image is transferred to the transfer material to which said yellow toner image has been transferred by the same means, finally, magenta color and black color, for example, are serially processed to transfer toner image with four colors to the transfer material. A full color image is formed by fixing the transfer material having said toner image with the four colors by action of heat and a pressure using, a fixing roller.

It is required that when heated, the toner used for the image forming method of said colors shows good melting property and mixing property of colors. A toner having low softening point, low melting viscosity, and a high sharp melt property is preferably used.

This means that the use of a toner having a high sharp melt property widens the range of color reproducibility of copied product allows to yield a colored copy showing high fidelity to the original manuscript image.

However, such color toner with a high sharp melt property has the tendency that the offset development, in which a part of toner power is moved to the surface layer of the fixing roller in fixing process, is easily occurs, and on the other hand, the tendency that the transfer material easily curls after fixation by strong heat shrinkage after fixation.

Particularly in the fixing apparatus in the color image forming apparatus has the tendency that offset and curling easily occur because a plurality of toner layers, namely, yellow, cyan, magenta, and black, are formed on the transfer material.

In recent years, a variety of copying is required. For example, copying on both sides is gradually increasing for copying to both surfaces of the transfer material with a purpose of reducing consumption of paper, based on recent ecological movement. Therefore, the problems of the curling of transfer material and offset occurring in the image formation on the reverse side should be solved.

To solve these problems, a means has conventionally adopted using a parting compound, e.g., dimethyl silicone oil, evenly applied to the roller in fixing process to reduce offset in the fixing process. However, there are many remained points to be improved.

On the other hand, a method has been published for forced prevention of curling by using a tool like a curl remover after the first fixing to reduce curling of transfer material after fixing. However, a roller mark appears on the image and the structure of the main body become complex, because this method requires to apply the roller to the surface of an image immediately after fixing.

If curling of the transfer material occurs after fixing of a toner image to one side of the transfer material, the transfer material cannot be smoothly carried through a roller for repeated feeding of paper for fixing on both sides and a passage for carrying the transfer material.

In addition, in transfer of a color toner to the reverse side of the transfer material, a problem easily occurs to stain the surface of transfer drum by silicone oil adhered to the surface of the transfer material, of which the first fixing has been completed, in the formation of image on the reverse side. More amount of the adhered silicone oil to the transfer material does not easily allow the transfer material to round evenly around the transfer drum, and this problem causes increased frequencies of transfer and also a change of performance of the surface of sheet of the transfer drum to lower sometimes the transfer performance of toner.

U.S. Pat. No. 5,437,949 proposes a color toner having a particular particle distribution to improve coloring performance of the color toner and U.S. Pat. No. 5,529,865 proposes a method for image formation to carry out smooth fixing of both sides by adjusting the particle distribution of the color toner. However, color toner and a method for image formation desired are those excellent in resistant performance to copying of multiple sheets and capable of smoother fixing of full color images for both sides, respectively.

U.S. Pat. No. 5,652,075 proposes a color toner assigned for particle distribution of pigment particles contained in the color toner particles, U.S. Pat. No. 5,607,806 proposes a toner in which alumina powder of a low crystallinity supplied from outside, EP Patent Publication No. 800117A1 proposes toner improved for fixing performance, color mixing, and resistance to offset. However, A color toner and a method for image formation desired are those excellent in resistant performance to copying of multiple sheets and capable of smoother fixing of full color images for both sides, respectively.

SUMMARY OF THE INVENTION

An object of the present invention is to provide a color toner in which a lowered image density and blurring do not occur in continuous copying or continuous printing of a color manuscript with a large image area.

Another object of the present invention is to provide a color toner to form a clear image without fogging and excellent in resistance stability.

Still another object of the present invention is to provide a color toner that stains a photosensitive member and the surface of a transfer drum in less frequencies.

A further object of the present invention is to provide a color toner excellent in fluidity and excellent in fidelity in development and transfer performance.

A further object of the present invention is to provide a color toner not easily affected by humidity, temperature, etc. and having a stable triboelectricity.

A further object of the present invention is to provide a color toner excellent in fixing performance and excellent in transparency of an overhead projector film.

A further object of the present invention is to provide a method for image formation to reduce considerably curling after once fixing of a transfer material, carry smoothly a transfer material in image formation on both sides of the transfer material, and make possible to yield a color image excellent in both sides and without image defect.

A further object of the present invention is to provide a method for image formation capable of yielding a good color image formed on both sides of a transfer material without the reduction of color reproducibility of a copied product or print.

One aspect of the present invention is directed to a color toner comprising color toner particles containing at least a binder resin and a colorant and an external additive, wherein (a) the color toner has a weight-average particle diameter of 5 to 8 $\mu$m and a number-average particle diameter of 4.5 to 7.5 $\mu$m, and contains 5 to 40% by number of particles having a particle diameter of 4 $\mu$m or less in the number distribution of the color toner and 7% by volume or less of particles having a particle diameter of 10.08 $\mu$m or more in the volume distribution of the color toner, (b) an inorganic powder selected from the group consisting of a strontium titanate powder, a cerium oxide powder and a calcium titanate powder, and a hydrophobic fine alumina powder are externally added to the color toner particles as the external additives, the inorganic powder has a longitudinal average particle diameter of 0.2 to 2 $\mu$m, and the hydrophobic fine alumina powder has a longitudinal average particle diameter of 0.005 to 0.1 $\mu$m, (c) the binder resin is a polyester resin crosslinked by a crosslinking agent, (d) the color toner particles contain 0 to 20 mg/lg of a chloroform insoluble matter, (e) the color toner has a storage modulus ($G'_{130}$) of $2\times10^3$ to $2\times10^4$ [dyn/cm$^2$] at a temperature of 130° C. and a storage modulus ($G'_{170}$) of $5\times10^3$ to $5\times10^4$ [dyn/cm$^2$] at a temperature of 170° C., and a value of $G'_{170}/G'_{130}$ is in the range of 0.25 to 10.

Another aspect of the present invention is directed to an image forming method comprising the steps of:

(1) electrically charging an electrostatic image carrier, exposing the charged electrostatic image carrier to form an electrostatic image on the electrostatic image carrier, developing the electrostatic image with a developer containing color toner to form a color toner image on the electrostatic image carrier, transferring the color toner image on the electrostatic image carrier onto one surface of a transfer material, and heating, pressurizing and fixing the transferred color toner image on the one surface of the transfer material by heating/pressurizing means, the color toner comprising (i) color toner particles containing at least a binder resin and a colorant and (ii) an external additive, wherein (a) the color toner has a weight-average particle diameter of 5 to 8 $\mu$m and a number-average particle diameter of 4.5 to 7.5 $\mu$m, and contains 5 to 40% by number of particles having a particle diameter of 4 $\mu$m or less in the number distribution of the color toner and 7% by volume or less of particles having a particle diameter of 10.08 $\mu$m or more in the volume distribution of the color toner, (b) an inorganic powder selected from the group consisting of a strontium titanate powder, a cerium oxide powder and a calcium titanate powder, and a hydrophobic fine alumina powder are externally added to the color toner particles as the external additive, the inorganic powder has a longitudinal average particle diameter of 0.2 to 2 $\mu$m, and the hydrophobic fine alumina powder has a longitudinal average particle diameter of 0.005 to 0.1 $\mu$m, (c) the binder resin is a polyester resin crosslinked by a crosslinking agent, (d) the color toner particles contain 0 to 20 mg/lg of a chloroform insoluble matter, (e) the color toner has a storage modulus ($G'_{130}$) of $2\times10^3$ to $2\times10^4$ [dyn/cm$^2$] at a temperature of 130° C. and a storage modulus ($G'_{170}$) of $5\times10^3$ to $5\times10^4$ [dyn/cm$^2$] at a temperature of 170° C., and a value of $G'_{170}/G'_{130}$ is in the range of 0.25 to 10;

(2) cleaning the color toner remaining on the electrostatic image carrier after transferred by cleaning means, electrically charging the cleaned electrostatic image carrier, exposing the charged electrostatic image carrier to form an electrostatic image on the electrostatic image carrier, developing the electrostatic image with a developer containing color toner to form a color toner image on the electrostatic image carrier, transferring the color toner image on the electrostatic image carrier onto the other surface of the transfer material with the color toner image fixed on the one surface, and heating, pressurizing and fixing the transferred color toner image on the other surface of the transfer material by the heating/pressurizing means to form the fixed color toner images on both the surfaces of the transfer material, the color toner comprising (i) color toner particles containing at least a binder resin and a colorant and (ii) an external additive, wherein (a) the color toner has a weight-average particle diameter of 5 to 8 $\mu$m and a number-average particle diameter of 4.5 to 7.5 $\mu$m, and contains 5 to 40% by number of particles having a particle diameter of 4 $\mu$m or less in the number distribution of the color toner and 7% by volume or less of particles having a particle diameter of 10.08 $\mu$m or more in the volume distribution of the color toner, (b) an inorganic powder selected from the group consisting of a strontium titanate powder, a cerium oxide powder and a calcium titanate powder, and a hydrophobic fine alumina powder are externally added to the color toner particles as the external additive, the inorganic powder has a longitudinal average particle diameter of 0.2 to 2 $\mu$m, and the hydrophobic fine alumina powder has a longitudinal average particle diameter of 0.005 to 0.1 $\mu$m, (c) the binder resin is a polyester resin crosslinked by a crosslinking agent, (d) the color toner particles contain 0 to 20 mg/lg of a chloroform insoluble matter, (e) the color toner has a storage modulus ($G'_{130}$) of $2\times10^3$ to $2\times10^4$ [dyn/cm$^2$] at a temperature of 130° C. and a storage modulus ($G'_{170}$) of $5\times10^3$ to $5\times10^4$ [dyn/cm$^2$] at a temperature of 170° C., and a value of $G'_{170}/G'_{130}$ is in the range of 0.25 to 10.

DETAILED DESCRIPTION OF THE PREFERRED EMBODIMENTS

Figure 1:
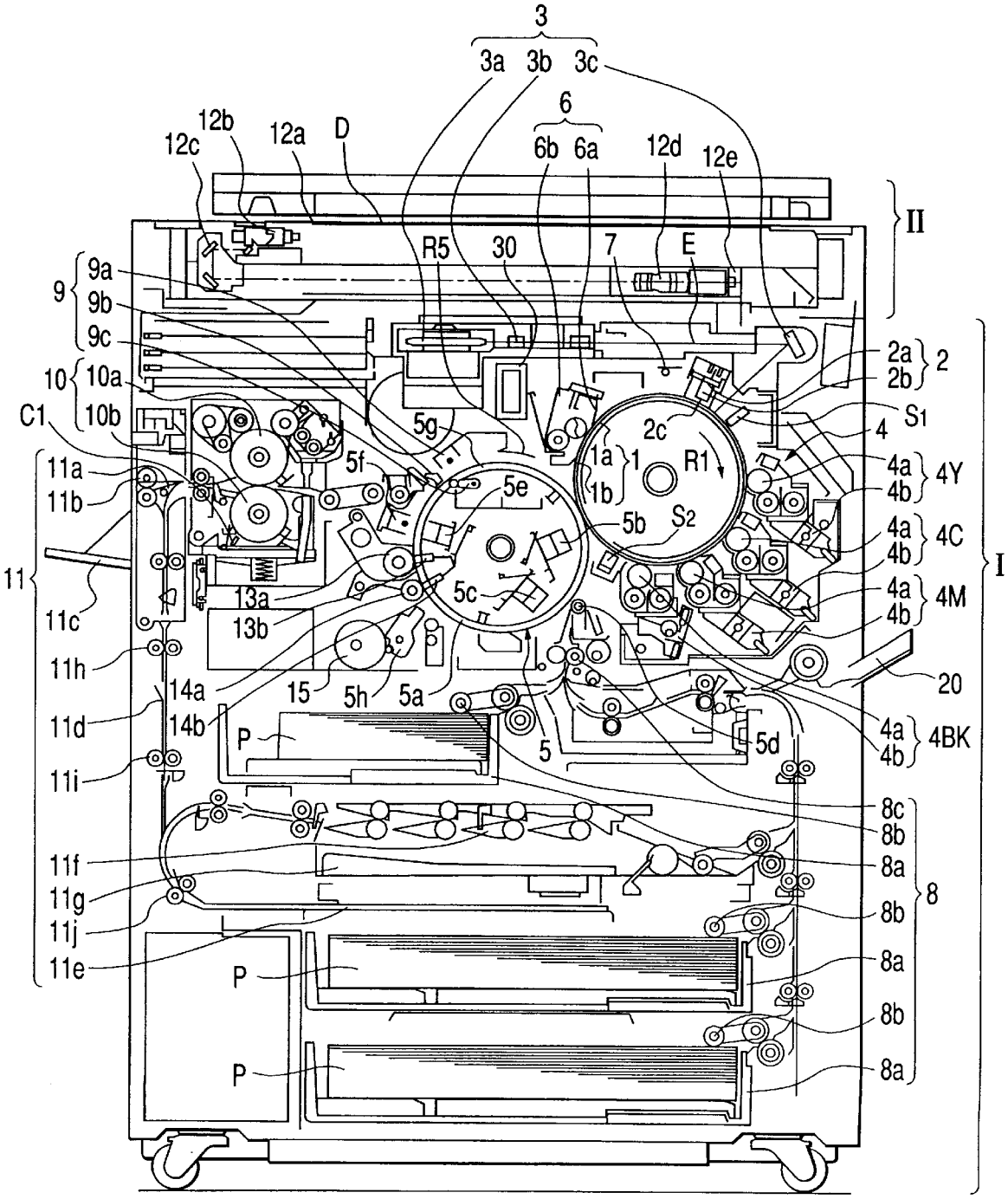
FIG. 1 is a schematic longitudinal section view showing the constitution of a laser beam printer of full colors to practice the method for image formation, of the present invention.

The present inventors studies on the concentration of image produced with a developing agent, reproducibility of a highlighted part, reproducibility of a fine line, etc. As a result, excellent fluidity of a toner and capability of developing with high fidelity to a static charged image on the photosensitive member were yielded from a toner having 5 to 8 μm mean toner weight average particle size and containing a certain fine powder as an external additive. In addition, for fixing to both sides, use of the toner having above particle size make possible to increase an apparent image concentration by filling spaces between toner particles, without heavy loading of the toner on the transfer material. The inventors found that the use of this type of toner is advantageous for the problem of curling in fixing on both sides and also reduce toner consumption necessary for realize a given image density to make it advantageous for cost.

Further, the inventors studies on the coloring performance of a toner, the particle size of the toner, and curling problem. Aforementioned effect is more prominent, when the coloring performance of an image density ($D_{0.5}$) usually after once fixing is 1.2 or over on the basis that a toner quantity unfixed (M/S) on the transfer material is adjusted to M/S=0.5 mg/cm$^2$.

The color toner of the present invention has a weight-average particle diameter of 5 to 8 μm and a number-average particle diameter of 4.5 to 7.5 μm. The particles having particle diameters of 4 μm or less in the particle number distribution of the color toner are present in a ratio of 5 to 40% by number, and the particles having particle diameters of 10.08 μm or more in the volumetric distribution of the color toner are present in a ratio of 7% by volume or less.

Mean toner parts by weighticle size of larger than 8 μm has a few number of fine particles contributable to high quality image and provides easily a high concentration of an image and excellent fluidity of the toner, however, fidelity adherence is difficult on fine static charged image formed on a photosensitive drum, the reproducibility of a highlighted part decreases, and image resolution reduces. Besides, an excess of unnecessary toner is loaded on the static charged image to cause a tendency to increase toner consumption.

On the contrary, the mean toner parts by weighticle size of smaller than 5 μm increases the quantity of electrified toner for a unit weight and reduction of image density, particularly reduction of image density at a low temperature and a low humidity, concentration becomes prominent. Such a particle size is undesirable for a use such as a graphic image in which an image area ratio is high.

Furthermore, the particle diameter less than 5 μm does not allow smooth contact electrification with a carrier and toners not fully electrified increases to result in a recognizable fogging by scattering to non-image part. To solve this problem, reducing the size of carrier diameter in order to increase a specific surface area of the carrier. However, a toner with the mean toner parts by weighticle size under 5 μm allows easy aggregation of the toner itself, even mixing with the carriers is difficultly achieved for a short time, a fogging occurs relating to resistance to continuous supply of the toner.

In the toner of the present invention, it is preferable that toner particles having a particle diameter of 4 μm or less are in the range of 5 to 40% by number, preferably 5 to 25% by number of the total number of the particles. If the toner particles having a particle diameter of 4 μm or less is less than 5% by number, the fine toner particles which are an essential component for a high quality are insufficient. Particularly, the effective toner particle component decreases along with the continuous use of toner by carrying on copying or printing out, so that the balance of the particle distribution of the toner shown in the present invention deteriorates and the image quality tends to gradually decline.

In toner particle more than 40% by number with a particle size of 4 μm or less, toner particles can easily aggregate each other and frequently behave as toner mass over the original particle size. As the result, coarse image can be easily formed, resolution lowers, or the concentration difference between the edge and inside of a static charged image increases to allow an image lacking the central part. For improvement of image quality, it is preferable that particles with a 10.08 μm or larger size are 7% by volume or less.

More preferably, particles with a size of 8 μm or larger are in the range of 10 to 45% by volume, particularly preferably, 15 to 40% by volume. If the amount of the particles is more than 45% by volume, an image quality deteriorates and an excessive load of toners occurs, which leads to the increase in toner consumption. On the other hand, if the amount of the particles is less than 10% by volume, the fluidity of toners deteriorates, so that the image quality is liable to decline.

To improve the effect of the present invention, particles with a size of 5.04 μm or less are preferably 7 to 50% by number, particularly 10 to 45% by number, for improvement of electrification and fluidity of the toner.

Next, a coloring performance of the toner will be described below.

Preferable image density ($D_{0.5}$) after normal fixing is high such as 1.2 or higher, preferably 1.3 or higher for coloring performance of the toner used for the present invention, when the amount of unfixed toner (M/S) is defined as M/S=0.5 g/cm$^2$.

Toner with a smaller particle size generally narrows distance between toner particles on the transfer material before fixing to yield a high image density for a small toner quantity as a result. On the other hand, in consideration of curling of the transfer material after fixing, curling easily occurs in (1) excessive toner amount loaded, (2) melting viscosity of toner as low as possible, and (3) fixing temperature as high as possible; particularly, curling becomes prominent in proportion to the amount of loaded toner.

Therefore, the present inventors studied on reduction of curling to make both sides image fixing possible, and found that the coloring performance of 1.2 or higher $D_{0.5}$ of toner having aforementioned distribution of toner viscosity reduces necessary toner amount to be loaded, satisfies the density of image, reduces curling as the result, and make achieve smooth carrying and image formation on the second side.

In addition, developing a static charged image on the photosensitive drum with a little amount of toner provides an advantage to transfer, reduces scattering, and has an effect of preventing the central lack of an image. This is very effective for realizing the formation of a high quality image.

However, on the contrary, a higher $D_{0.5}$ than 1.8 causes a extremely high content of pigment contained in the toner and may result in unsatisfactory fixing and unnecessary fogging.

Thus, $D_{0.5}$ of the toner used for the present invention is preferably 1.2 or higher and 1.8 or lower, more preferably, 1.3 or higher and 1.7 or lower In the color toner of the present invention, (i) powder of strontium titanate of 0.2 to 2 μm mean longitudinal particle size, powder of cerium oxide of 0.2 to 2 μm mean longituginal particle size, or powder of calcium titanate of 0.2 to 2 μm mean longitudinal particle size, as inorganic powder and (ii) fine powder of hydrophobic alumina of 0.005 to 0.1 μm mean longitudinal particle size are externally added to color toner particles. A certain inorganic fine powder with 0.2 to 2 μm mean longitudinal particle size and fine powder of hydrophobic alumina of 0.005 to 0.1 μm mean longitudinal particle size externally added to color toner particles improve color toners in fluidity, resistance to copying of multiple sheets, and stability in environment and prevent the occurrence of fogging in a non-image part.

Inorganic powder externally added for good accomplishment of above effects is preferably 0.01 to 2 parts by weight, more preferably 0.05 to 1 parts by weight with respect to 100 parts by weight of color toner particles.

Fine powder of hydrophobic alumina externally added for good accomplishment of above effects is preferably 0.5 to 5 parts by weight, more preferably 0.6 to 3 parts by weight with respect to 100 parts by weight of color toner particles.

Fine powder of hydrophobic alumina is superior to fine powder of hydrophobic silica and fine powder of hydrophobic titanium oxide in absorbing silicone oil.

Particularly in the case that a fine alumina powder surface-treated with a silane organic compound is added to the inorganic powder as the color toner particles, the electrification stability of the color toner, the improvement of fluidity, and the absorbency of silicone oil are extremely good.

The present inventors studied on the stability of electrification and increase in the absorbency of silicone oil without lowering fluid performance of alumina fine powder. As the result, they found that alumina fine powder made by surface treatment of alumina fine powder of high surface activity with a silane organic compound is particularly useful. Activated alumina having crystal structure of y type has a high surface activity to be effective for the present invention.

In the present invention, BET specific surface area in the condition underwent hydrophobic treatment is preferably 130 $m^2/g$ or larger, more preferably, 150 to 400 $m^2/g$. BET specific surface area of 130 $m^2/g$ or larger improves absorbency and adsorption of silicone oil.

In the present invention, the surface-treated alumina fine powder is particularly effective which can be prepared by subjecting the fine powder of aluminum ammonium carbonate hydroxide represented by the following general formulae (I) and (II) to a pyrolysis treatment, and then making the resultant alumina fine powder hydrophobic:

$$NH_4AlO(OH)HCO_3 \quad (I)$$

$$NH_4AlCO_3(OH)_2 \quad (II)$$

It is preferable that aluminum ammonium carbonate hydroxide represented by the general formula $NH_4AlO(OH)HCO_3$ or $NH_4AlCO_3(OH)_2$ is burned under oxygen atmosphere and a temperature in the range of 300 to 1200° C. to yield alumina fine powder. For example, alumina fine powder yielded by the chemical reaction of $2NH_4AlCO_3(OH)_2 \rightarrow Al_2O_3+2NH_3+3H_2O+2CO_2$ is preferable A burning temperature in the range between 300 to 1200° C. raises activity and realize a high yield of alumina with a high BET specific surface area.

Burning temperature higher than 1200° C. abruptly increases content of alumina with crystal structure of α type in alumina fine powder produced. Alumina fine powder structurally develops to increase primary particle size and BET specific surface area decreases. Besides, condensation of alumina fine particles strengthen to require large energy for dispersion of alumina fine powder in processing step. In alumina fine powder in such state, fine powder having a few aggregated particles is not easily produced.

On the other hand, burning temperature lower than 300° C. does not allow complete or sufficient pyrolysis of aluminum ammonium carbonate hydroxide and such gas components as $H_2O$, $NH_3$, and $CO_2$ remain in alumina fine powder produced. In this case, hydrophobic degree cannot be raised to a target level for even hydrophobic treatment. Even if apparent hydrophobic degree is increased, stable electrification is difficultly realized to cause various problems in resistance to multiple copying. More preferable burning temperature is in the range of 300° C. to 1100° C., and further preferable burning temperature is 400° C. to 1000° C.

Next, a hydrophobic treatment agent for alumina fine powder will be described below.

A hydrophobic treatment agent may be selected in consideration of control of triboelectric characteristic of color toner and stability of triboelectricity of color toner under high humidity environment. For example, a silane organic compound such as alkyl alkoxysilane, siloxane, silane, and silicone oil are recommended to prevent pyrolysis of itself at reaction treatment temperature.

Particularly preferable is a silane coupling agent. The use of alkyl alkoxysilane represented by the following general formula and having volatility and both of a hydrophobic group and a reactive binding group $$R_m—Si—Y_n$$

(wherein R represents an alkoxy group, m represents an integral number of 1 to 3, Y represents a hydrocarbon group such as alkyl group, vinyl group, glycidoxy group, or methacryl group, and n represents an integral number of 1 to 3).

More preferably, alkylalkoxysilane represented by the formula $C_aH_{2a+1}—Si—(OC_bH_{2b+1})_3$ (wherein a represents an integral number of 4 to 12, b represents an integral number of 1 to 3) is recommended.

If a in the general formula is less than 4, the treatment is easy, but it is difficult to obtain good hydrophobic properties. Furthermore, if a is more than 13, the hydrophobic properties are satisfactory, but the fine particles mutually agglomerate, so that a fluidity imparting performance tends to deteriorate. In addition, if b is more than 3, its reactivity lowers, so that it is difficult to obtain the good hydrophobic properties. Therefore, in the present invention, a is preferably in the range of 4 to 12, more preferably 4 to 8, and b is preferably in the range of 1 to 3, more preferably 1 to 2.

Examples of the alkylalkoxysilane include vinyltrimethoxy silane, vinyltriethoxy silane, γ-methacryl oxypropyl trimethoxy silane, vinyltriacethoxy silane, methyltrimethoxysilane, methyltriethoxysilane, isobutyl trimethoxysilane, dimethyl dimethoxysilane, dimethyl diethoxysilane, trimethyl methoxysilane, hydroxypropyl trimethoxysilane, phenyl trimethoxysilane, n-hexadecyl trimethoxysilane, and n-octadecyl trimethoxysilane.

The recommended amount for treatment by silane coupling agent is 1 to 50 parts by weight, preferably 3 to 45 parts by weight, to 100 parts by weight of alumina fine powder. The hydrophobic degree of hydrophobic alumina fine powder is 30 to 90%, preferably 40 to 80%.

If the hydrophobic degree is less than 30%, electrified quantity by long term discharge at high humidity lowers, and a mechanism to enhance electrification is required in the main body of an apparatus, which results in the complication of the apparatus. In addition, the absorbency of silicone oil decreases to cause easily irregular oil distribution on the surface of a fixed image. On the other hand, if the hydrophobic degree is more than 90%, it is difficult to control the electrification of alumina fine powder itself, so that the toner easily charges up at a low humidity.

In consideration of fluidity performance of color toner, the longitudinal average particle size of treated alumina fine powder is preferably 0.005 to 0.1 $\mu$m, more preferably 0.005 to 0.05 $\mu$m.

The longitudinal average particle size larger than 0.1 $\mu$m decreases fluidity, makes electrification of color toner uneven, and allows easy scattering of toner and easy fogging to prevent to form a high quality image. Average particle diameter less than 0.005 $\mu$m allows to bury easily fine powder of hydrophobic alumina in the surface of color toner particles, makes deterioration of toner easy, and makes decrease in resistance easy. The tendency is distinct than applying to color toner particles with sharp melt property. A diameter less than 0.005 $\mu$m increases the activity of alumina particles, allows easy aggregation of alumina particles, difficultly yields an objective high fluidity. For particle size of fine powder of hydrophobic alumina in the present invention, alumina particles of 0.001 $\mu$m or more are measured by using a transmission electron microscope.

Further in the present invention, BET specific surface area of fine powder of hydrophobic alumina is preferably 130 $m^2/g$ or more, more preferably 150 to 400 $m^2/g$.

BET specific surface area less than 130 $m^2/g$ allows partial mixing of alumina of which particles have grown or alumina which has changed to alumina having $\alpha$ type crystal structure. Thus, a high fluidity of the object is difficultly yielded by this particle size. Very high BET shown in an untreated step before treatment easily decreases in a treatment step. BET specific surface area become less than 130 $m^2/g$ as the result is not preferable, because alumina particles reacted to a treating agent in the aggregated state without dispersion evenly in a solution and also because the treating agent itself was self-condensed to make oily state resulting in adhering to alumina particles or the surface of the aggregate.

In treating method for alumina fine powder, an effective method is to treat by hydrolyze a coupling agent dispersing alumina fine powder in a solution to become mechanically the primary particle size.

The amount of a fine powder of hydrophobic alumina treated with a silane coupling agent which is suitable for the present invention is in the range of 0.5 to 5 parts by weight, preferably 0.6 to 3 parts by weight, more preferably 0.7 to 2.5 parts by weight with respect to 100 parts by weight of the toner particles.

A parts by weight less than 0.5 decreases fluidity performance of toner particles. On the contrary, a parts by weight more than 5 is not preferable, because electrifying performance of carrier itself is decreased by staining of carrier surface with treated alumina fine powder that has left toner. Treated free alumina fine powder is easy to scatter on the surface of photosensitive member in development of an image and also easy to cause insufficient cleaning. Further, for the use as color toner, excessive content of treated alumina fine powder generate a shadow of a projected image of an overhead projector to inhibit to yield a clear image.

Binder resin used for color toner in the present invention is a polyester resin crosslinked with a crosslinker such as trimellitic acid. For crosslinking of a polyester resin, modulus of elasticity ($G'_{130}$) in store of color toner at a temperature of 130° C. is $2\times10^3$ to $2\times10^4$ [dyn/cm$^2$], modulus of elasticity ($G'_{170}$) in store of color toner at a temperature of 170° C. is $5\times10^3$ to $5\times10^4$ [dyn/cm$^2$], and the quotient of $G'_{170}/G'_{130}$ requires to be 0.25 to 10. For crosslink of a polyester resin, it is more preferable that in addition to crosslinking by a crosslinker such as trimellitic acid, crosslinked structure by an organic metal compound is formed in the preparation step of toner particles.

In color toner having the aforementioned viscoelastic characteristic, color mixing with a color toner with a different color tone is better, anti-offset performance is excellent, fixing to both sides difficultly allows to damage a fixed image and round around a roller.

Dihydric alcohol components to form a polyester resin are exemplified by ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, bisphenol A hydroxide, a bis-phenol derivative represented by the formula A (A)

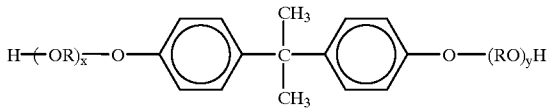

(wherein R is ethylene and propylene, x and y each is a integral number of 1 or more, and a mean value of x+y is 2 to 10).

Trihydric or polyhydric alcohol components working as a crosslinker to form a non linearly crosslinked polyester resin are exemplified by sorbitol, 1,2,3,6-hexanetetrol, 1,4-sorbitan, pentaerythritol, dipentaerythritol, tripentaerythritol, 1,2,4-butanetriol, 1,2,5-pentane triol, glycerol, 2-methyl propanetriol, 2-methyl-1,2,4-butanetriol, trimethylol ethane, trimethylol propane, and 1,3,5-trihydroxy benzene. The used amount of trihydric or polyhydric polyalcohols is preferably 0.1 to 1.9 mol % on the basis of total monomers.

Dicarboxylic acid components to make a polyester resin are exemplified by fumaric acid, maleic acid, maleic anhydride, succinic acid, adipic acid, sebacic acid, malonic acid, and aliphatic acid component monomers of which such acids have been substituted by saturated or unsaturated hydrocarbon groups having carbon numbers of 8 to 22. In addition, aromatic acid component monomers are exemplified by phthalic acid, isophthalic acid, phthalic anhydride, telephthalic acid, and ester derivatives thereof.

Tricarboxylic or higher polycarboxylic acid components working as a crosslinker to make a non linearly crosslinked polyester resin are exemplified by 1,2,4-benzene tricarboxylic acid, 1,2,5-benzene tricarboxylic acid, 1,2,4-naphthalene tricarboxylic acid, 2,5,7-naphthalene tricarboxylic acid, 1,2,4,5-benzene tetracarboxylic acid, and their anhydrides and esterified compounds. The used amount of tricarboxylic or higher polycarboxylic acid components is preferably 0.1 to 1.9 mol % on the basis of total monomers.

Preferable glass transition temperature polyester resin ranges 50 to 80° C., more preferably 51 to 75° C. Number average molecular weight (Mn) measured by GPC of a polyester component soluble in THF is preferably 1000 to 9000, more preferably 1500 to 7500. The molecular weight of a main peak (Mp) is preferably 5000 to 12000, more preferably 5500 to 11000. The ratio (Mw/Mn) of weight average molecular weight (Mw) of a polyester component soluble in THF and Mn is preferably 5.0 or lower.

Particularly, it is preferable that a polyester resin is made non-linear by a tricarboxylic or higher polycarboxylic acid component or a trihydric or polyhydric alcohol component, and the content of insolubles in chloroform by the undermentioned measurement method is preferably in the range of 0 to 1% by weight, more preferably 0 to 0.9% by weight, most preferably 0 to 0.5% by weight based on the weight of the polyester resin.

A polyester resin having 1% by weight or less components insoluble in THF and non-linear structure is preferably formed by two steps: the first step produces a linear prepolymer by condensation polymerization of a dicarboxylic acid component or a dicarboxylic acid ester component, and a dihydric alcohol component; the second step operates condensation polymerization the linear prepolymer, a dicarboxylic acid component (or a dicarboxylic acid ester), a dihydric alcohol component, and a tricarboxylic or higher polycarboxylic acid component (or, acid anhydride of ester thereof), or a trihydric or polyhydric alcohol component.

It is preferable on the point of stabilizing triboelectricity and stabilizing properties of electronic photography under various conditions that the acid value of a polyester resin ranges 1 to 30 mg KOH/g (more preferably, 3 to 25 mg KOH/g).

A particularly preferable polyester resin is the polyester resin having a molecular skeleton represented by the following formula (B)

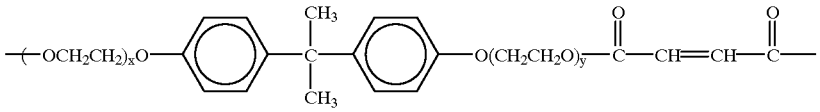

(B)

(wherein x and y each represents an integral of 1 or more, and the mean value of x+y is in the range of 2 to 4).

In the polyester resin having a molecular skeleton represented by the formula (B), it is more preferable that the non-linear structure is formed of polycarboxylic acid component or polyhydric alcohol component.

In the polyester resin having a molecular skeleton represented by the formula (B), crosslinking structure of metal ions is easily formed by an organic metal compound in heating to allow to adjust the modulus of elasticity in store better.

The molecular skeleton represented by the formula (B) existing in a polyester resin makes affinity with an organic metal compound excellent; by the affinity, a π electron and oxygen atoms in

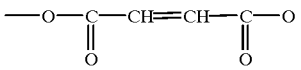

of the molecular skeleton represented by the formula (B) supply electrons to a metal contained in the organic metal compound to have a certain coordination. This action is particularly prominent in that the metal atom is aluminum atom. This is because that an aluminum atom lacks two electrons from the octet of electrons (8 electrons forming 4 electron pairs ) in aluminum atom having 3 bonds in an organic metal compound; thus, the organic metal compound containing the aluminum atom receives two more electrons to have 8 electrons.

Interrelationship is formed between molecules by chemical affinity that appears between a metal atom like aluminum or a metal atom of bivalence and a molecular skeleton, and that differs from the strong crosslink of a metal ion with a side chain or a terminal carboxylic group of a conventional binder resin. This realizes innovative fixing performance at a low temperature resistance to offset at a high temperature and gives rise to a new interaction effect between a polyester resin and the metal compound of an organic acid to very improve the following acting effects of (1) to (5), particularly of fixing performance and transfer efficiency.

(1) Offset resistant performance is improved without raising a start temperature for fixing. Toner does not aggregate in keeping for a long time at a high temperature (45° C.) condition, keeping the condition same as before and showing a little change of developing performance.

(2) Transfer performance is excellent. A halftone (medium color) image can be reproduced on transfer paper (or, transfer material) with fidelity. Besides, the amount of toner remained after transfer is small to prevent adhesion of toner in cleaning of the surface body of the holder of static charged image and the occurrence of a scratch in cleaning work.

(3) Fluidity of color toner is excellent to maintain stable, good electrifying performance (developing performance) under respective environmental conditions such as a low temperature with a low humidity and a high temperature with a high humidity resulting in prevention of the occurrence of fogging and the scattering of toner in an image forming apparatus.

(4) An electrifying member such as a sleeve for development and carrier particles are less stained to allow good image formation equal to the initial stage of development in a long term use.

(5) In preparation of color toner, dispersion of a coloring agent to polyester resin is good and a satisfactory density of image can be achieved by adding a small amount of coloring agent. Good dispersion of the coloring agent makes easy reuse of classified fine powder in classification step after making to fine powder in toner preparation.

More preferable polyester resin is a polyester resin having a molecular skeleton represented by a formula —C—D—C—D—

(wherein C is

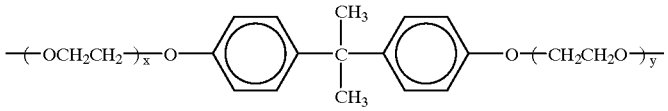

(wherein x and y each represents an integral number of 1 or more)

D represents

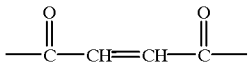

to which the molecular skeleton represented by the formula (B) and also having non-linear structure made by tricarboxylic or higher polycarboxylic acid or polyhydric alcohol.

The polyester resin having a molecular skeleton represented by the formula —C—D—C—D— and a non-linear structure can be formed by carrying out the condensation polymerization of a bisphenol derivative represented by the following formula (E)

(E)

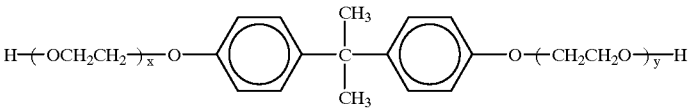

(herein x and y each is an integral number of 1 or more, and the mean value of x+y is in the range of 2 to 4) and fumaric acid to form a prepolymer, and then subjecting, to condensation polymerization, the thus formed prepolymer a diol, a dicarboxylic acid, and a tricarboxylic or higher polycarboxylic acid or a polyhydric alcohol.

The mechanisms how the molecular skeleton represented by the formula (B) specifically acts to an organic metal compound has not been clearly known. However, a possible explanation is that the flexuous chain of the molecule easily forms an ordination easy to interact (interaction of molecular ordination), a phenyl group as an electron donor to P position has an electron donation property, and —CH═CH— has interaction for π electron donation.

On the other hand, when a bisphenol derivative has a propoxy group as shown in the following formula (F), (F)

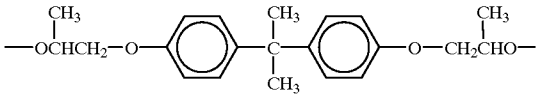

a methyl group exists; no prominent active effect as shown above has been found possibly because of steric hindrance of the methyl group.

In addition, the molecular skeleton composed of ethylene glycol and telephthalic acid and represented by the following formula (G)

(G)

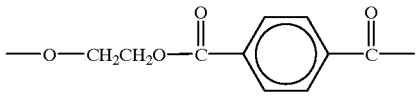

does not show any prominent active effect. Further, the molecular skeleton composed of ethylene glycol and fumaric acid and represented by the following formula (H):

(H)

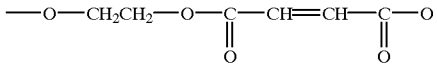

does not show any prominent active effect.

In color toner of the present invention, a part of color toner particles insoluble in chloroform is 0 to 20 mg/g. The part of color toner particles insoluble in chloroform is the value measured by the following method.

[Method for Measurement of a Part of Color Toner Particles Insoluble in Chloroform]

In the case that some external additives are externally added to the color toner particles, a chloroform-insoluble part is measured after the external additives are removed from the color toner particles. Alternatively, a chloroform-insoluble part of the external additives which are added externally to the color toner particles is previously measured, and a chloroform-insoluble part of the color toner to which the external additives are externally added is then measured. Afterward, the chloroform-insoluble part of the external additives is subtracted from the chloroform-insoluble part of the color toner, thereby obtaining the chloroform-insoluble part of the color toner particles.

One gram of color toner particles is added to 50 ml chloroform at room temperature to stir and dispersed by sonication for 5 min., and chloroform solution yielded is filtered to separate a part insoluble in chloroform by using a membrane filter (weight $W_{1g}$). The membrane filter, on which a part insoluble in chloroform has been loaded, is dried to remove chloroform, and the weight of membrane filter ($W_{2g}$), on which the part insoluble in chloroform has been loaded, is measured to calculate the weight of the part insoluble in chloroform per 1 g of color toner particles.

Weight of the part insoluble in chloroform (mg/lg) $=W_2-W_1$. The weight $W_1$ and $W_2$ are measured up to the order of 0.1 mg. The membrane filter is exemplified by fluoropore membrane filter (Type FP-100; pore size 10.00 $\mu$m; diameter 47 mm) made by Sumitomo Electric Ind., Ltd.

In color toner particles, of which a part insoluble in chloroform is 0 to 20 mg/lg of color toner particles, there is a few amount of coloring agent with coarse particle diameter and the coloring agent has been finely dispersed in a polyester resin crosslinked, and a few resin component having very large molecular weight and insoluble in chloroform has been contained in the crosslinked polyester resin contained in color toner particles.

When a part of color toner particles insoluble in chloroform is 0 to 20 mg/1 g (more preferably, 0 to 15 mg/1 g), modulus of elasticity in store of color toner at a temperature of 130° C. is $2\times10^3$to $2\times10^4$[dyn/cm$^2$], modulus of elasticity ($G'_{170}$) in store of color toner at a temperature of 170° C. is $5\times10^3$ to $5\times10^4$ [dyn/cm$^2$], and the quotient of $G'_{170}/G'_{130}$ requires to be 0.25 to 10 (more preferably, 0.5 to 10 and further preferably, 1 to 10), light transmissivity or light permeability is excellent for colored fixing image on OHP film used for overhead projector, multicolor fixing image, and full color fixing image, color mixing performance between color toners in fixing with heat and pressure is excellent, fixing performance is excellent, resistance to offset is excellent, balance between the fixing performance and resistance to offset is better, and formation of full color image on both sides of transfer material by fixing with heat and pressure gives rise to a little gross attaching on surface and reverse side, the differences of image quality is small, and prevent the occurrence of a damage of fixed image formed on the surface subjected to twice steps of fixing with heat and pressure.

Known dye or/and pigment are used for coloring agent for color toner.

Coloring pigment for magenta toner are exemplified by C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, and 209; C.I. pigment violet 19; C.I. vat red 1, 2, 10, 13, 15, 23, 29, 35, etc.

A pigment can be independently used. However, The combined use of a dye with a pigment improves definition of color to be more preferable for the quality of full color image.

Dyes for magenta toner are exemplified by such dyes soluble in oil as C.I. solvent red 1, 3, 8, 23, 24, 25, 27, 30, 49, 81, 82, 83, 84, 100, 109, and 121, ; C.I. disperse red 9; C.I. solvent violet 8, 13, 14, 21, and 27; C.I. disperse violet 1; and such basic dyes as C.I. basic red 1, 2, 9, 12, 13, 14, 15, 17, 18, 22, 23, 24, 27, 29, 32, 34, 35, 36, 37, 38, 39, 40; C.I. basic violet 1, 3, 7, 10, 14, 15, 21, 25, 26, 27, and 28.

Coloring pigment for cyan toner are exemplified by C.I. pigment blue 2, 3, 15, 16, and 17; C.I. vat blue 6; C.I. acid blue 45 or copper phthalocyanin pigment made by substitution of 1 to 5 phthalimido methyl group to a phthalocyanin skeleton having the structure represented by the following formula

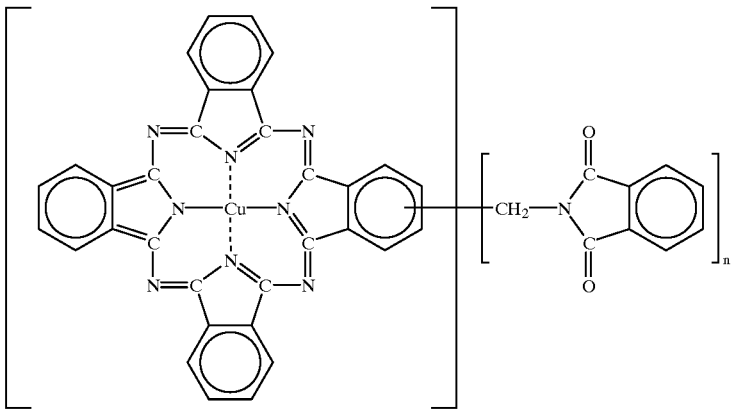

(wherein n represents an integral number of 1 to 5).

Coloring pigment for yellow toner are exemplified by C.I. pigment yellow 1, 2, 3, 4, 5, 6, 7, 10, 11, 12, 13, 14, 15, 16, 17, 23, 65, 73, 83, 97, and 180; C. I. vat yellow 1, 3, and 20.

The amount of coloring agent is preferably in the range of 0.1 to 15 parts by weight, more preferably 0.5 to 12 parts by weight, and most preferably 3 to 10 parts by weight with respect to 100 parts by weight of a binder resin.

The color toner particles which can be used in the present invention can be prepared by sufficiently mixing polyester resins, a pigment or a dye as a colorant, and if necessary, a charge controlling agent and other additives by the use of a mixing machine such as a ball mill; melting, mixing and kneading the mixture by using a heat kneader such as a heat roll, a kneader or an extruder to compatibilize the resins in each other; dispersing or dissolving the pigment or the dye therein; cooling the material to solidify it; grinding the solid; and then strictly classifying it to obtain the desired color toner particles.

When unfixed toner amount (M/S) is defined as M/S =0.5 mg/cm$^2$, color toner having coloring performance to make image density ($D_{0.5}$) after usually once fixing 1.2 or higher and 1.8 or lower can be preferably yielded by the following method for dispersing pigments.

To improve dispersing state of pigment particles contained in color toner particles, it is preferable that the first polyester resin and a paste pigment containing 5 to 50% by weight of pigment particles insoluble in dispersion medium are put in a kneader or a mixing machine to heat mixing under no pressure and to melt the first polyester resin, a paste pigment (i.e., pigment in a liquid phase) is transferred to melted resin phase of the hot first polyester resin, the first polyester resin and pigment particles are melted and kneaded, liquid component is removed by evaporation to dry up, the first kneaded product is yielded containing the first polyester resin and pigment particles, subsequently, the second polyester resin and if necessary, charge controlling agent or other additives, are added to the first kneaded product to make a mixture, the mixture is heated, melted, and kneaded to yield the second kneaded product, the second kneaded product obtained is cooled, pulverized, and classified to prepare a toner. For reference, the first polyester resin and the second polyester resin may be identical or different polyester resin.

Said paste pigment is in the state of the pigment particles existing without no experience of a drying step in the process of preparing pigment particles. In other words, a state in which 5 to 50% by weight of pigment particles exist in total paste pigment in state of approximately primary particles. Residual 50 to 95% by weight contained in the past pigment contains volatile liquid in a large part together with a small amount of dispersant and assistant. The volatile liquid is not specially restricted, if a liquid is volatilizable by common heating. However, the liquid particularly preferably used in the present invention and also ecologically preferably used is water.

Insoluble pigment particle is a pigment particle insoluble in dispersion medium that is a volatilizable liquid contained in a paste pigment and also is dispersible in a paste pigment.

For instance, if water is selected for a volatilizable liquid, pigment particles insoluble in water are all insoluble pigment particles.

It is preferable that a paste pigment contains 5 to 50% by weight, more preferably 5 to 45% by weight, of pigment particles insoluble in water. The content of insoluble pigment exceeds 50% by weight decreases dispersion efficiency in polyester resin requiring a high kneading temperature or a long kneading time. In addition, a strong screw and paddle components are essentially required for a kneading machine to cause easily cleavage of chains of a polymer.

On the contrary, when a paste pigment contains insoluble pigment less than 5% by weight as solid component, the objective content of pigment can be yielded by only putting a large amount of paste pigment in a mixing machine; this is not preferable due to need of using a large machine. Moreover, if it is less than 5% by weight, a step of removing water in steps after the first kneading has to be strengthen to remove water completely, resulting in a large load on the polyester resin.

The proportion of a pigment to a polyester resin in conversion to a solid component in kneading or mixing the paste pigment and polyester resin is 10:90 to 50:50, preferably 15:85 to 45:55.

When the proportion of a pigment to a polyester resin is less than 10% by weight, the larger amount of polyester resin than the paste pigment has to be put in a kneading machine; this easily causes segregation of the pigment in kneaded product. To make the segregated product even, a longer kneading time is required, resulting in an excessive load on the polyester resin to make change of the characteristics of the polyester resin possible.

When the proportion of a pigment to a polyester resin is higher than 50% by weight, pigment particles in liquid phase not smoothly moves to the polyester resin, and in melting and kneading after moving of the pigment particles, the kneaded product difficultly has even melted state resulting in difficulty of good dispersion.

The reason why melting and kneading is preferably carried out under non-pressurized condition is because a liquid, e.g., water, in a paste pigment under a pressure attacks a polyester resin to cause possibly partial hydrolytic reaction, denaturation of the polyester resin, or decrease in resistant performance to offset. Therefore, it is preferable in the present invention that melting and kneading of the first polyester resin and the paste pigment carried out under non-pressurized condition.

Kneading machines are exemplified by a heat kneader, a single screw extruder, a twin screw extruder, and kneader; particularly preferable is the heat kneader.

For containing an agent to control electric charge in color toner particles, the content of the agent to control electric charge ranges 3 parts by weight to 10 parts by weight, preferably ranges 4 parts by weight to 8 parts by weight for 100 parts by weight of binder resin.

The use of the agent to control electric charge reduces the initial fluctuation of electrified quantity and allows easily absolute electrified quantity necessary for development of an image, resulting in the prevention of the occurrence of fogging and reduction of image density.

Furthermore, if necessary, a lubricant such as metal salt of fatty acid (e.g., zinc stearate, aluminum stearate) and fine powder of a polymer containing fluorine (e.g., fine powder of polytetrafluoroethylene, polyvinylidene fluoride, etc. and tetrafluoroethylene vinylidene fluoride copolymer), or an electroconductive material (e.g., tin oxide and zinc oxide) may be added.

As a carrier for combined use with color toner of the present invention used for a developing agent made of two components, for example, such metals as iron, nickel, copper, zinc, cobalt, manganese, chromium, earth metals of which surface has been oxidized or not oxidized, their alloys or oxides, and ferrite can be used.

Particularly, a magnetic ferrite particles containing three elements, Mn—Mg—Fe, and made from the components of manganese, magnesium, and iron as the main component is preferable as carrier particles. In addition, it is particularly preferable in the use of silicone resin as a coating resin for magnetic ferrite particles that the magnetic ferrite particles containing three elements, Mn—Mg—Fe, contains silicone element of 0.001 to 1% by weight (more preferably 0.005 to 0.5% by weight).

It is preferable that the magnetic carrier particles are coated with a resin; the resin is preferably silicone resin. Particularly, denatured silicone resin made by the reaction of silicone resin containing nitrogen or silane coupling agent containing nitrogen to the silicone resin is preferable in the point of donor performance of negative triboelectric charge to color toner of the present invention, environmental stability, and the prevention of stain of carrier surface.

The average particle diameter of the magnetic carrier is preferably in the range of 15 to 50 $\mu$m, more preferably 25 to 45 $\mu$m when considered from the relationship with the weight-average particle diameter of the color toner.

For the average particle diameter and particle size distribution of the magnetic carrier, a laser diffraction type particle size distribution measuring device HELOS (manufactured by JEOL Ltd.) is used in combination with a dry type dispersion unit RODOS (manufactured by JEOL Ltd.). The range of particle diameters 0.5 $\mu$m to 350.0 $\mu$m is divided into 31 channels as shown in Table 1 below, measurement is performed under measurement conditions: a lens focal distance of 200 mm; a dispersion pressure of 3.0 bar; and a measurement time of 1 to 2 seconds, and 50% particle diameter of the volume distribution (median diameter) is obtained as the average particle diameter. Additionally, the volumet of particles in each particle diameter range is obtained from the frequency distribution on a basis of volume.

TABLE 1

| Particle Diameter Range (μm) | Particle Diameter Range (μm) | Particle Diameter Range (μm) | Particle Diameter Range (μm) |
|---|---|---|---|
| 0.5–1.8 | 6.2–7.4 | 25.0–30.0 | 102.0–122.0 |
| 1.8–2.2 | 7.4–8.6 | 30.0–36.0 | 122.0–146.0 |
| 2.2–2.6 | 8.6–10.0 | 36.0–42.0 | 146.0–174.0 |
| 2.6–3.0 | 10.0–12.0 | 42.0–50.0 | 174.0–206.0 |
| 3.0–3.6 | 12.0–15.0 | 50.0–60.0 | 206.0–246.0 |
| 3.6–4.4 | 15.0–18.0 | 60.0–72.0 | 246.0–294.0 |
| 4.4–5.2 | 18.0–21.0 | 72.0–86.0 | 294.0–350.0 |
| 5.2–6.2 | 21.0–25.0 | 86.0–102.0 | |

The laser diffraction type particle size distribution measuring device HELOS for use in the measurement of the particle size distribution uses Furanhofer diffraction principle for measurement. The measurement principle will be briefly described. When a laser beam is radiated to particles to be measured from a laser source, a diffraction image is formed on a focal plane of a lens opposite to the laser source. The diffraction image is detected by a detector, and arithmetic operation is performed to calculate the particle size distribution of the particles to be measured.

In a method of preparing the magnetic particles provided with the aforementioned average particle diameter and specific particle size distribution, for example, classification can be performed using a screen. Particularly, in order to perform the classification with good precision, it is preferable to repeatedly screen the particles a plurality of times using the screen with appropriate openings formed therein. Moreover, the shapes of the screen openings may be controlled by plating or otherwise for effective screening.

When a two-component developer is prepared by mixing the color toner therewith, the mixture ratio or concentration of toner in the developer is in the range of 2% to 15% by weight, preferably 4% to 13% by weight, which usually produces good results. When the toner concentration is less than 2%, the image density tends to be lowered. When it exceeds 15% by weight, the occurrence of fogging and in-device flying tends to be increased, and the use-life of the developing agent is shortened.

Methods of measuring various physical properties will next be described.

(1) Method of measuring the particle size distribution and average particle diameter of the color toner or color toner particles:

For a measuring device, Coulter counter TA-II or Coulter multi-sizer II (manufactured by Coulter Ltd.) is used. For electrolyte solution, first-class sodium chloride is used to prepare about 1% NaCl aqueous solution. For example, ISOTON-II (manufactured by Coulter Scientific Japan Ltd.) can be used. In the measuring method, 0.1 to 5 ml of surface-active agent (preferably, alkyl benzenesulfonate) is applied as a dispersing agent to 100 to 150 ml of the aqueous electrolyte solution, and 2 to 20 mg of measurement sample is further applied thereto. The electrolyte solution with the sample suspended therein is subjected to dispersion process in a ultrasonic dispersion unit for about one to three minutes. In the measuring device, the volume and number of toner particles for each channel are measured using a 100 μm aperture to calculate the volume and number distributions of the toner. Subsequently, the weight-average particle diameter D4 of the toner is obtained on a basis of weight from the volume distribution of the toner particles (the middle value of each channel is obtained as the representative value of each channel).

For the channels, 13 channels are used: 2.00 to 2.52 μm; 2.52 to 3.17 μm; 3.17 to 4.00 μm; 4.00 to 5.04 μm; 5.04 to 6.35 μm, 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

(2) Method of measuring the longitudinal average particle diameter of fine alumina powder:

For the primary particle diameter, the fine alumina powder is observed with a transmission electron microscope, and diameters of 100 particles with a size of 0.001 μm or more in a field of view are measured to obtain the longitudinal average particle diameter. The dispersed particle diameters of the fine alumina powder on the toner particles are observed with a scanning electron microscope, 100 fine alumina particles in a field of view are qualitatively analyzed by XMA, and the particle diameters are measured to obtain the average particle diameter.

(3) Method of measuring the hydrophobic degree of the fine alumina powder:

A methanol titration test is an experimental test by which the hydrophobic degree of the fine alumina powder having a hydrophobic surface is confirmed.

The methanol titration test for evaluating the hydrophobic degree of the treated fine alumina powder is performed as follows:

Added to 50 ml of water in a container is 0.2 g of sample fine alumina powder. Methanol is titrated via a buret until the total amount of fine alumina powder is wetted. In this case, the solution in the container is constantly stirred with a magnetic stirrer. The terminal point is observed when the total amount of fine alumina powder is suspended in liquid, and the hydrophobic degree is represented by the percentage of methanol in the liquid mixture of methanol and water when the terminal point is reached.

(4) Method of measuring BET specific surface area:

The actual measurement of BET of the fine alumina powder is performed as follows:

A fully-automatic gas adsorption measuring device or Autosorb 1 manufactured by Yuasa Ionics K. K. is used, nitrogen is used as adsorbent gas, and BET specific surface area is obtained by BET multi-point method. As the preprocessing of the sample, deaeration is performed at a temperature of 50° C. for 10 hours.

(5) Method of analyzing the crystalline structure:

In the present invention, the crystalline structure of the fine alumina powder is analyzed as follows:

The X-ray crystalline structure analysis is performed by X-ray diffraction spectrum using Kα ray of Cu characteristic X-ray as a ray source. For example, a strong fully-automatic X-ray diffraction device $MXP^{18}$ (manufactured by Mac Science Ltd.) can be used as a measuring device.

Figure 3:
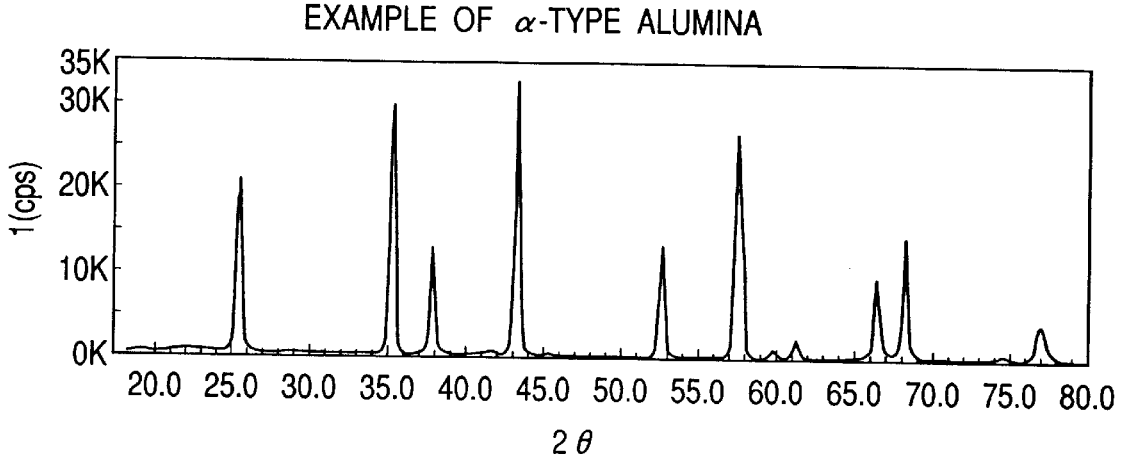
FIG. 3 is a figure showing an X-ray diffraction pattern of alumina having the crystal structure of $\alpha$-type.
Figure 4:
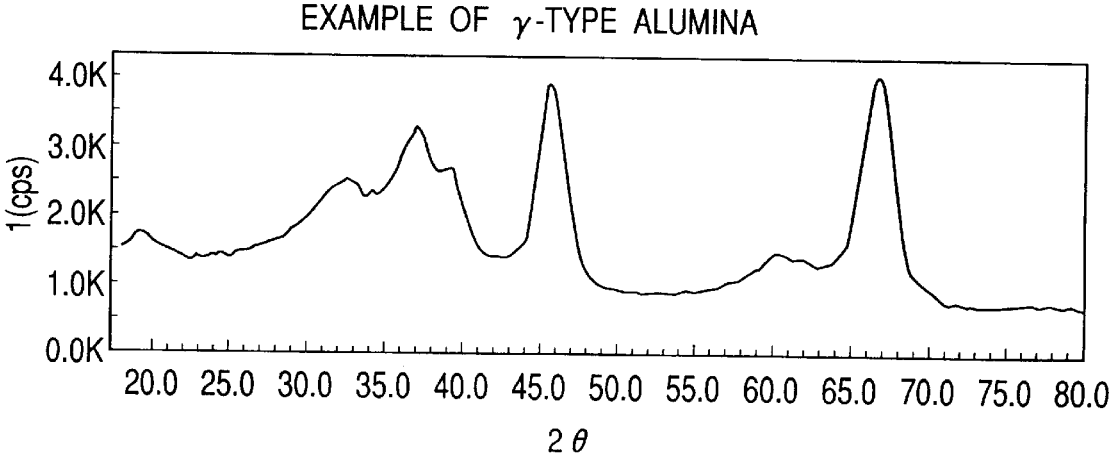
FIG. 4 is a figure showing an X-ray diffraction pattern of alumina having the crystal structure of $\gamma$-type.

When the alumina has a clear crystalline structure, i.e., it is of α type, a sharp peak is observed in the range of 2 (deg) from 20 to 70. When the alumina is of γ type, some broad peaks are observed. As an illustration, FIGS. 3 and 4 show typical diffraction peaks of α and γ types.

[Measurement of Rheological Characteristics of Toner]

The toner is pressure-molded into a disc-shaped sample with a diameter of about 25 mm and a thickness of about 2 to 3 mm. Subsequently, the sample is set on a parallel plate, and the measurement of temperature dispersion is performed while temperature is gradually raised in the range of 50 to 200° C. The temperature raising rate is 2° C./min. The angular frequency ω is fixed to 6.28 rad/sec, and the distortion ratio is automatically set. The value at each temperature is read with the temperature on the abscissa and the storage modulus G on the ordinate. For example, RDA-II (manufactured by Rheo Metrics Ltd.) is used for measurement.

[Method of measuring GPC of Polyester Resin or Polyester Resin constituting Color Toner]

Measured by gel permeation chromatography (GPC) are Mn, Mw and Mw/Mn of polyester resin. A column is stabilized in a heat chamber of 40° C., tetrahydrofuran (THF) as a solvent is allowed to flow through the column at the temperature at a flow rate of 1 ml per minute, and 100 μl of THF sample solvent is injected to perform measurement. When the molecular weight of the sample is measured, the molecular weight distribution of the sample is calculated from the relationship between the logarithmic value of calibration curve prepared by various types of monodisperse polystyrene standard samples and the counted number. As the standard polystyrene sample for preparing the calibration curve, for example, the sample manufactured by Tosoh Corp. or the sample having a molecular weight of about $10^2$ to $10^7$ manufactured by Showa Denko K. K. may be used. It is appropriate to use at least ten samples of standard polystyrene. As a detector is used R1 (refractive index) detector. As the column, several polystyrene gel columns on the market may be combined for use.

Examples of the column include a combination of Shodex GPC KF-801, 802, 803, 804, 805, 806, 807, 800P manufactured by Showa Denko K. K., a combination of TSK gel G1000H ($H_{XL}$), G2000H ($H_{XL}$), G3000H ($H_{XL}$), G4000 ($H_{XL}$), G5000H ($H_{XL}$), G6000H ($H_{XL}$), G7000 ($H_{XL}$) TSK guard column, and the like.

For example, the sample is prepared as follows:

After the sample is inserted in THF and left to stand for several hours, it is sufficiently stirred and well mixed with THF (until the coalescence of the sample is eliminated). The sample is further left to stand for 12 hours or more. The shelf time of the sample in THF needs to be 24 hours or more in total. Thereafter, the sample is passed through a sample processing filter (with a pore size of 0.45 to 0.5 μm, e.g., Maishori Disc H-25-5 manufactured by Tosoh Corp., Ekikuro Disc 25CR manufactured by German Science Japan Co., or the like can be used) to obtain the sample of GPC. The sample concentration is adjusted in such a manner that the resin content is in the range of 0.5 to 5 mg/ml.

A preferred embodiment of an image forming device for performing an image forming method comprising an opposite surface fixing process according to the present invention will be described below with reference to FIG. 1.

The image forming device shown in FIG. 1 is provided with a lower digital color image printer section (hereinafter referred to simply as the printer section) I and the digital color image reader section (hereinafter referred to simply as the reader section) II. For example, an image is formed on a recording material P by the printer section I based on the image of original D read by the reader section II.

The structures of the printer section I and the reader section II will successively be described hereinafter.

The printer section I comprises a photosensitive drum 1 as an electrostatic image carrier which is rotated/operated in a direction of an arrow R1. A primary charger (charging means) 2, exposure means 3, a developing device (developing means) 4, a transfer device 5, a cleaner 6, a pre-exposure lamp 7, and the like are arranged in order along the rotating direction around the photosensitive drum 1. A sheet supply conveyor 8 of the recording material P is disposed below the transfer device 5 (i.e., in the lower half portion of the printer section I), and separating means 9 is installed in the upper portion of the transfer device 5. Moreover, a heating/pressurizing fixer 10 and a sheet discharge section 11 are disposed on the downstream side of the separating means 9 (on the downstream side relative to the conveying direction of the recording material P).

The photosensitive drum 1 comprises a drum-shaped base 1*a* of aluminum and a photosensitive member 1*b* of OPC (organic photo semiconductor) for covering the surface of the base 1*a,* and is rotated/operated at a predetermined process speed (peripheral speed) in the direction of the arrow R1 by drive means (not shown).

The primary charger 2 is a corona charger which comprises a shield 2*a* having an opening opposite to the photosensitive drum 1, a discharge wire 2*b* disposed parallel with the bus of the photosensitive drum 1 inside the shield 2*a,* and a grid 2*c* disposed in the opening of the shield 2*a* for regulating the charged electric potential. A charging bias is applied to the primary charger 2 by a power supply (not shown), so that the surface of the photosensitive drum 1 is uniformly charged to have predetermined polarity and electric potential.

The exposure means 3 comprises a laser output section (not shown) for emitting laser beams based on an image signal from the reader section II described later, a polygonal mirror 3*a* for reflecting the laser beams, a lens 3*b* and a mirror 3*c*. The exposure means 3 exposes the photosensitive drum 1 by irradiating the surface of the photosensitive drum 1 with the laser beams, and removes the electric charge of the exposed portion to form an electrostatic latent image. In the embodiment, the electrostatic latent image formed on the surface of the photosensitive drum 1 is color-separated into four colors, i.e., yellow, cyan, magenta and black based on the image of the original, and the electrostatic latent image corresponding to each color is successively formed.

The developing device 4 is provided in order from the upstream side along the rotating direction (the direction of the arrow R1) of the photosensitive drum 1 with developing device 4Y, 4C, 4M, 4Bk, in which yellow toner, cyan toner, magenta toner and black toner (developer) are stored, respectively. Each of the developing device 4Y, 4C, 4M, 4Bk comprises a developing sleeve 4*a* which carries the developer containing the toner for developing the electrostatic image formed on the photosensitive drum 1. The developeing device of the predetermined color for use in the development of the electrostatic image is alternatively placed in the developing position close to the surface of the photosensitive drum 1 by an eccentric cam 4*b*. The toner of the developer carried by the developing sleeve 4*a* develops the electrostatic image, and a toner image (visible image) is formed as a sensible image. The three-color developing devices other than the developing device for use in the development are retracted from the developing position.

The transfer device 5 comprises a transfer drum (transfer material carrier) 5*a* for carrying the transfer material P on the surface, a transfer charger (transfer charging means) 5*b* for transferring the toner image on the photosensitive drum 1 to the transfer material P, an adsorption charger 5*c* for adsorbing the transfer material P to the transfer drum 5*a,* an adsorption roller 5*d* opposed to the adsorption charger 5*c,* an inner charger 5*e,* and an outer charger 5*f*. A transfer material carrying sheet 5*g* of a dielectric material is integrally extended in a cylindrical shape in an open area of a peripheral surface of the transfer drum 5*a,* whose shaft is supported in such a manner that the sheet is rotated/operated in a direction of an arrow R5. A dielectric sheet like a polycarbonate film is used in the transfer material carrying sheet 5*g*. The transfer device 5 is constituted in such a manner that the transfer material P is adsorbed and carried on the surface of the transfer drum 5*a*.

The cleaner 6 is provided with a cleaning blade 6*a* for scraping off the toner remaining on the surface of the photosensitive drum 1 without being transferred to the transfer material P, and a cleaning container 6*b* for collecting the scraped toner.

The pre-exposure lamp 7 is disposed adjacent to the upstream side of the primary charger 2 to remove unnecessary electric charge from the surface of the photosensitive drum 1 cleaned by the cleaner 6.

The sheet supply conveyer 8 comprises a plurality of sheet supply cassettes 8*a* on which the transfer materials P different from one another in size are stacked/stored, a sheet supply roller 8*b* for supplying the transfer material P from the sheet supply cassette 8*a,* a multiplicity of conveying rollers, a resist roller 8*c,* and the like, and supplies the transfer material P of a predetermined size to the transfer drum 5*a*.

The separating means 9 comprises a separating charger 9*a* for separating the transfer material P with the toner image transferred thereto from the transfer drum 5*a,* a separating click 9*b,* a separation lifting roller 9*c,* and the like.

The heating/pressurizing fixer 10 comprises a fixing roller 10*a* incorporating a heater therein, and a pressurizing roller 10*b* disposed below the fixing roller 10*a* for pushing the transfer material P against the fixing roller 10*a*.

The sheet discharge section 11 comprises a conveying path switching guide 11*a,* a discharge roller 11*b,* a sheet discharge tray 11*c,* and the like, which are disposed on the downstream side of the heating/pressurizing fixer 10. Moreover, disposed below the conveying path switching guide 11*a* are a vertical conveying path 11*d,* a reverse path 11*e,* a stacking member 11*f,* an intermediate tray 11*g,* conveying rollers 11*h,* 11*i,* a reverse roller 11*j,* and the like for forming images on opposite surfaces of one transfer material P.

Furthermore, in the periphery of the photosensitive drum 1, an electric potential sensor $S_1$ for detecting the charged electric potential of the photosensitive drum surface is disposed between the primary charger 2 and the developing device 4, and a concentration sensor $S_2$ for detecting the concentration of the toner image on the photosensitive drum 1 is disposed between the developing device 4 and the transfer drum 5*a*.

The reader section II will next be described. The reader section II disposed above the printer section I comprises a glass 12*a* on which the original D is laid, an exposure lamp 12*b* for exposing/scanning the image surface of the original D while moving, a plurality of mirrors 12*c* for further reflecting the light reflected from the original D, a lens 12*d* for converging the reflected light, a full color sensor 12*e* for forming a separated color image signal based on the light from the lens 12*d,* and the like. The separated color image signal is passed through an amplification circuit (not shown), subjected to processing by a video processing unit (not shown), and sent to the aforementioned printer section I.

The operation of the image forming device constituted as described above will next be described. In the following description, a four or full color image is formed of yellow, cyan, magenta and black in order.

The image of the original D laid on the glass 12*a* of the reader section II is irradiated by the exposure lamp 12*b,* and color-separated. First, a yellow image is read by the full color sensor 12*e,* subjected to a predetermined processing, and transmitted to the printer section I as an image signal.

In the printer section I, the photosensitive drum 1 is rotated/operated in the direction of the arrow R1, and the surface of the drum is uniformly charged by the primary charger 2. A laser beam is radiated from the laser output section of the exposure means 3 based on the image signal transmitted from the reader section II, and the charged surface of the photosensitive drum 1 is exposed by a light image E via the polygonal mirror 3*a* and the like. Electric charge is removed from the exposed portion of the surface of the photosensitive drum 1, so that an electrostatic image is formed corresponding to yellow. In the developing device 4, the yellow developing device 4Y is placed in the predetermined developing position, and the other developing devices 4C, 4M, 4Bk are retracted from the developing position. Yellow toner is attached to the electrostatic image on the photosensitive drum 1 by the developing device 4Y to form a yellow toner image. The yellow toner image on the photosensitive drum 1 is transferred to the transfer material P carried by the transfer drum 5*a*. The transfer material P of a size suitable for the original image is supplied to the transfer drum 5*a* from the predetermined sheet supply cassette 8*a* via the sheet supply roller 8*b,* the conveying roller, the resist roller 8*c,* and the like at the predetermined timing. The transfer material P supplied as described above is adsorbed around the surface of the transfer drum 5*a* and rotated in the direction of the arrow R5. The yellow toner image on the photosensitive drum 1 is transferred to the transfer material P by the transfer charger 5*b*.

On the other hand, after the toner image is transferred, the toner remaining on the surface of the photosensitive drum 1 is removed by the cleaner 6, and unnecessary electric charge is removed by the pre-exposure lamp 7. The photosensitive drum 1 is prepared for the next image forming process starting with the primary electric charging.

The aforementioned processes of reading the original image by the reader section II, transferring the toner image to the transfer material P on the transfer drum 5*a,* cleaning the photosensitive drum 1, and removing electricity are performed in the same manner for the colors of cyan, magenta and black other than yellow. The four-color toner images of yellow toner, cyan toner, magenta toner and black toner are transferred to the transfer material P on the transfer drum 5*a* in such a manner that the images are overlapped with one another.

The transfer material P to which the four-color toner images are transferred is separated from the transfer drum 5*a* by the separating charger 9*a,* the separating click 9*b,* and the like, and conveyed to the fixer 10 while non-fixed toner images are held on the surface. The transfer material P is heated/pressurized by the fixing roller 10*a* and the pressurizing roller 10*b* of the heating/pressurizing fixer 10. The color toner images are fused and fixed to form a full-color image on one surface of the transfer material P. The transfer material P with the image fixed thereon is discharged onto the sheet discharge tray 11*c* by the discharge roller 11*b*.

The heating/pressurizing fixing device 10 will next be described with reference to FIG. 2.

Figure 2:
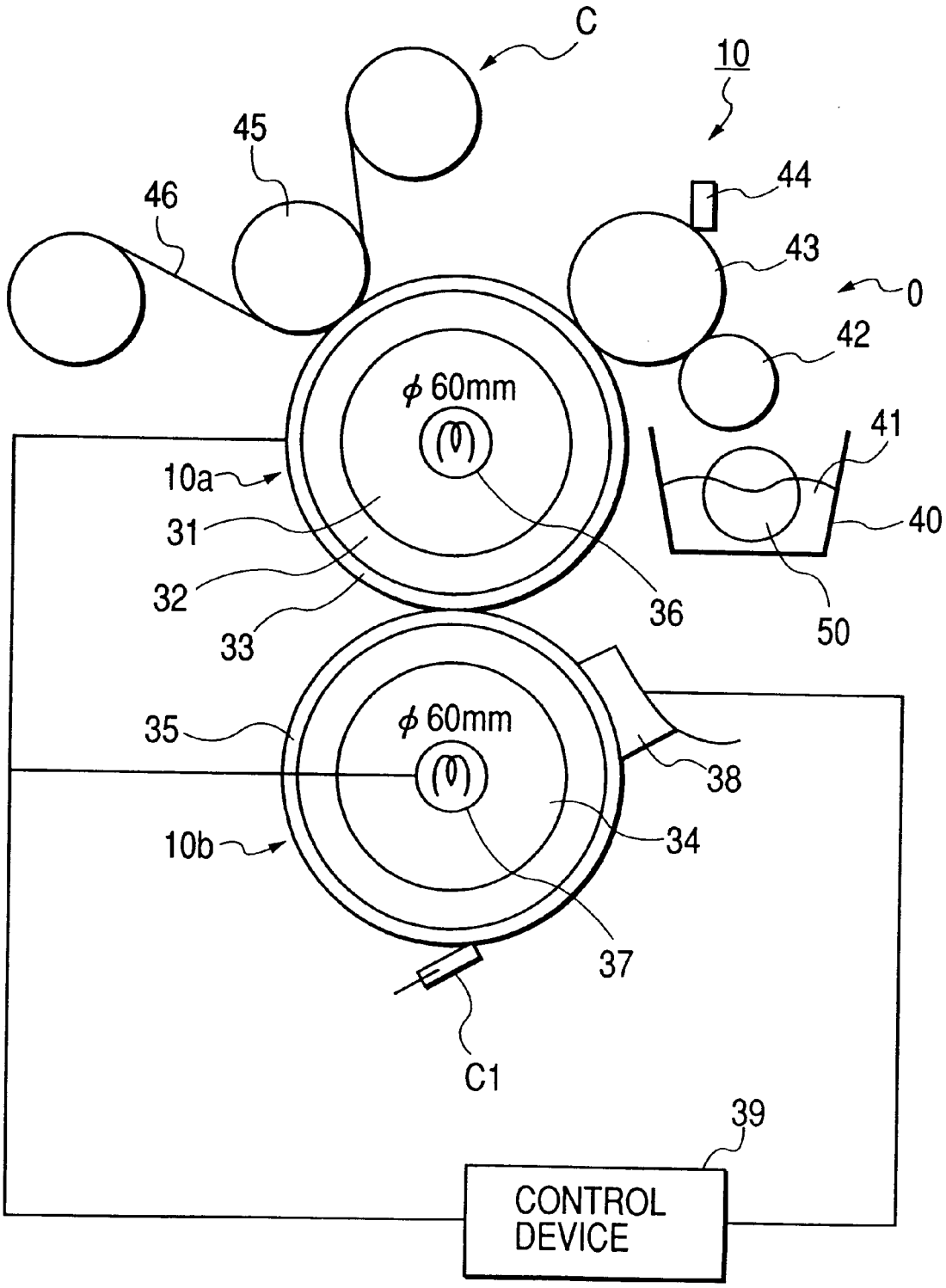
FIG. 2 is diagram showing the structure of heating and pressurizing fixing apparatus.

In FIG. 2, the fixing roller 10*a* to be brought in contact with the color toner images comprises, for example, a core metal 31 of aluminum, a 1 mm thick HTV (high temperature vulcanizable) silicone rubber layer 32 on the core metal 31, and a specific additional silicone rubber layer 33 outside the layer 32, and is formed in a diameter of 60 mm.

On the other hand, the pressurizing roller 10*b* is formed, for example, by forming a 1 mm thick HTV and a 1 mm thick specific additional silicone rubber layer 35 on a core metal 34 of aluminum, to have a diameter of 60 mm.

The fixing roller 10*a* has heating means or conveying roller heater 36 disposed in the core metal 31, and the pressurizing roller 10*b* similarly has a heater 37 disposed in the core metal 34, so that the transfer material P is heated from its opposite surfaces. The temperature of the pressurizing roller 10*b* is detected by a thermistor 38 abutting on the pressurizing roller 10 *b,* and the halogen heaters 36, 37 are controlled based on the detected temperature by a control device 39 in such a manner that the temperatures of the fixing roller 10 *a* and the pressurizing roller 10 *b* are constantly maintained at 170° C. Additionally, the fixing roller 10*a* and the pressurizing roller 10 *b* are pressurized under a total pressure of about 80 kg by a pressurizing mechanism (not shown).

Moreover, in FIG. 2, character O denotes an oil application device, C. denotes a cleaning device, and C1 denotes a cleaning blade for removing oil or dirt from the pressurizing roller 10*b*. In the oil application device O, dimethyl silicone oil 41 in an oil pan 40 is passed through oil pumping rollers 50, 42 and an oil application roller 43, and the amount of oil to be applied is regulated by an oil application amount adjusting blade 44. The oil 41 is applied to the fixing roller 10*a*. In the cleaning device C, the surface of the fixing roller 10*a* is cleaned by a web 46 which is brought in contact with the fixing roller 10*a* by a thrust roller 45.

In the fixing device 10, the transfer material P with the non-fixed toner image carried on its surface is held/conveyed by a fixing nipper between the fixing roller 10*a* and the pressurizing roller 10*b*. Since the transfer material P is heated/pressurized from its opposite surfaces, the toner is fixed. In this case, the toner attached to the fixing roller 10*a* and the pressurizing roller 10*b* is removed by the cleaning device C and the cleaning blade C1.

The formation of the full-color image on one surface of the transfer material has been described. A method and device for forming full-color sensible images on both the surface and the back surface of the transfer material will next be described with reference to FIG. 1.

When the full-color images are formed on the opposite surfaces of the transfer material P, the transfer material P discharged from the heating/pressurizing fixer 10 is once guided to the reverse path 11*e* via the conveying path 11*d* by operating the conveying path switching guide 11*a*. Thereafter, by reversing the reverse roller 11*j,* the transfer material P is discharged with its supplied rear end reversed as a tip end in the direction opposite to the supply direction, and stored in the intermediate tray 11*g*. Thereafter, the transfer material P with the full-color image formed on its one surface is supplied to the transfer drum 5*a* from the intermediate tray 11*g*. By performing the aforementioned image forming process again, the yellow toner, the cyan toner and the magenta toner are transferred to the other surface of the transfer material P. The black toner is further transferred. Since the full-color image of the transfer material P abuts on the transfer drum 5*a,* the silicone oil attached to the full-color image plane at the time of fixing is attached to the transfer drum 5*a,* which usually tends to inhibit the transfer process. However, since the color toner of the present invention is superior in absorbency of silicone oil, the amount of silicone oil attached to the transfer drum 5*a* is remarkably smaller as compared with the conventional art.

The transfer material P having non-fixed color-toner images on its other surface is separated from the transfer drum 5*a,* and supplied to the heating/pressurizing fixer 10, in which the non-fixed color toner images are heated, pressurized and fixed on the other surface of the transfer material P. Therefore, the full-color images are formed on the opposite surfaces of the transfer material P. Since the color toner of the present invention is formed by externally adding the specific hydrophobic fine alumina powder to the color toner particles, it has specific particle size distribution and viscoelasticity characteristics. Therefore, the full-color images can effectively be formed on the opposite surfaces, and the transfer material P is prevented from being wound around the fixing roller 10*a* and the pressurizing roller 10*b*. The occurrence of offset phenomenon is effectively prevented.

When the color toner of the present invention is used, the transfer drum 5*a* and the transfer material carrying sheet 5*g* are less contaminated with silicone oil or the like as compared with the conventional art, but they may be cleaned by a fur brush 13*a,* a backup brush 13*b,* an oil removing roller 14*a* and a backup brush 14*b,* if necessary. The cleaning is performed before or after the image is formed if necessary, and may be performed whenever jam (paper clogging) occurs.

[Synthesis Example 1 for Hydrophobic Fine Alumina Powder]

2*l* of a 0.2 mol ammonium alum solution was added dropwise to 3l of a 2 mol ammonium bicarbonate solution at 0.8l/h while keeping the solution at 35° C., and these compounds were allowed to react with each other with vigorous stirring, to form a fine powder of aluminum ammonium carbonate hydroxide [$NH_4AlCO_3(OH)_2$]. It was filtered and dried. The fine powder of aluminum ammonium carbonate hydroxide thus prepared had a BET specific surface area of 280 $m^2/g$. The fine powder was thermally treated at around 900° C. for 2 h, to form the hydrophilic fine alumina powder. The hydrophilic fine alumina powder thus prepared had a BET specific surface area of 250 $m^2/g$, primary particle's longitudinal average particle diameter of 5 nm, methanol hydrophobicity of 0%, and crystalline morphology of γ system, as confirmed by X-ray diffractometry.

The above fine alumina powder was homogeneously dispersed in toluene, to which isobutyltrimethoxysilane was added dropwise at 30 parts by weight as the solid per 100 parts by weight of the fine alumina powder, in such a way to prevent the alumina particles from agglomerating each other. They were mixed with each other for hydrolysis. The hydrolysis effluent was filtered, dried, thermally treated at 180° C. for 2 h, and then sufficiently shredded, to produce the hydrophobic fine alumina powder No. 1. This powder had a primary particle's longitudinal average particle diameter of 0.005 μm (5 nm), BET specific surface area of 190 $m^2/g$, and methanol hydrophobicity of 66%.

[Synthesis Example 2 for Hydrophobic Fine Alumina Powder]

Commercial fine aluminum oxide powder as γ-alumina (Nippon Aerosir's Oxide-C, BET specific surface area: 100 $m^2/g$) was treated to become hydrophobic in a manner similar to that for Synthesis Example 1 with 15 parts by weight of isobutyltrimethoxysilane, to produce the hydrophobic fine alumina powder No. 2. Its properties are given in Table 2.

[Synthesis Example 3 for Hydrophobic Fine Alumina Powder]

γ-alumina prepared by the hydrolysis of organoaluminum (BET specific surface area: 149 $m^2/g$) was treated to become hydrophobic in a manner similar to that for Synthesis Example 1 with 15 parts by weight of isobutyltrimethoxysilane, to produce the hydrophobic fine alumina powder No. 3. Its properties are given in Table 2.

[Synthesis Example 4 for Hydrophobic Fine Alumina Powder]

$NH_4AlCO_3(OH)_2$ used in Synthesis Example 1 was fired at around 1260° C. for around 60 min, to prepare fine α-alumina powder. This powder was confirmed to be of α-alumina by X-ray diffractometry, because of the presence of the sharp diffraction peaks. Its properties are given in Table 2. The fine α-alumina powder thus prepared was treated to become hydrophobic in a manner similar to that for Synthesis Example 1 (although reduced to 10 wt. % of treating agent), to produce the hydrophobic fine alumina powder No. 4. Its properties are given in Table 2.

[Synthesis Example for Hydrophobic Fine Silica Powder]

Commercial hydrophilic fine silica powder (Nippon Aerosir's AEROSIR200, BET specific surface area: 200 $m^2/g$) was treated to become hydrophobic in a manner similar to that for Synthesis Example 1, to produce the hydrophobic fine silica powder. Its properties are given in Table 2.

[Synthesis Example for Hydrophobic Fine Titanium Oxide Powder]

Amorphous, fine titanium oxide powder prepared by the oxidation of titanium alkoxide (BET specific surface area: 135 $m^2/g$) was treated to become hydrophobic in a manner similar to that for Synthesis Example 1 with 20 parts by weight of isobutyltrimethoxysilane, to produce the hydrophobic fine titanium oxide powder. Its properties are given in Table 2.

TABLE 2

| Powder types | BET specific surface area of the base material ($m^2/g$) | Hydrophobicizing agent | Dosage of hydrophobicizing agent (parts by weight per 100 parts by weight of the base material) | Primary particle's longitudinal average particle diameter (nm) | Hydrophobicity (%) | BET specific surface area ($m^2/g$) |
|---|---|---|---|---|---|---|
| Hydrophobic fine alumina powder No. 1 | 250 | Isobutyltrimethoxysilane | 30 | 5 | 66 | 190 |
| Hydrophobic fine alumina powder No. 2 | 100 | Isobutyltrimethoxysilane | 15 | 20 | 62 | 86 |
| Hydrophobic fine alumina powder No. 3 | 146 | Isobutyltrimethoxysilane | 15 | 10 | 61 | 130 |
| Hydrophobic fine alumina powder No. 4 | 20 | Isobutyltrimethoxysilane | 10 | 150 | 30 | 20 |
| Hydrophobic fine silica powder | 200 | Isobutyltrimethoxysilane | 30 | 5 | 32 | 185 |
| Hydrophobic fine titanium oxide powder | 135 | Isobutyltrimethoxysilane | 30 | 17 | 62 | 82 |

[Preparation Example 1 for Polyester Resin]

A linear prepolymer having a number-average molecular weight ($M_n$) of 850 was prepared by the polycondensation of the following monomers:

a diol component (E-1) shown by: 25 mol %

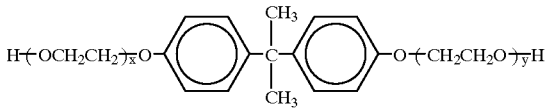

wherein, x+y=2.1, fumaric acid (HOOC—CH=CH—COOH) 25 mol %

The prepolymer thus prepared was mixed and polycondensed with the following monomers to prepare the nonlinear, crosslinked polyester resin (1):

a diol component shown by: 20 mol %

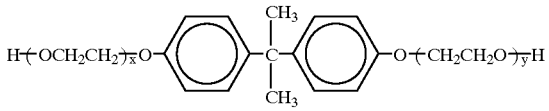

wherein, x+y=2.1, a diol component shown by: 5 mol %

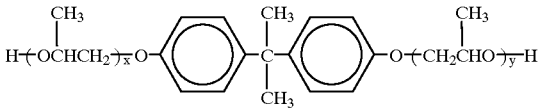

wherein, x+y=2.1, fumaric acid 10 mol % terephthalic acid 10 mol % trimellitic acid 0.2 mol %

The crosslinked polyester resin (1) thus prepared had a glass transition temperature ($T_g$) of 59° C., chloroform insoluble matter of 0 wt. %, number-average molecular weight ($M_n$) of 3200 determined by GPC for the THF soluble matter, main peak ($M_p$) of 8400, and $M_w/M_n$ of 3.6.

The chloroform insoluble matter in the polyester resin was determined by the following method:

The polyester resin (1 g) was added to 50 mL of chloroform at room temperature, stirred, and dispersed by the aid of ultrasonic waves for 5 min. The chloroform insoluble matter was separated by a membrane filter (weight: $W_{1g}$). The filter carrying the insoluble matter was dried to remove chloroform, and its weight ($W_{2g}$) was measured. The chloroform insoluble matter content was determined by the following formula:

$$\text{Chloroform insoluble matter (wt. \%)}=(W_{2(g)}-W_{1(g)}/1_{(g)})\times 100$$

[Preparation Example 2 for Polyester Resin]

A linear prepolymer having a number-average molecular weight ($M_n$) of 850 was prepared by the polycondensation of the following monomers:

a diol component shown by: 25 mol %

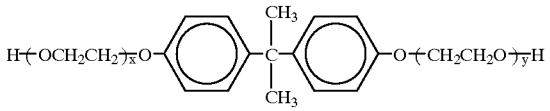

wherein, x+y=2.1, fumaric acid 25 mol %

The prepolymer thus prepared was mixed and polycondensed with the following monomers to prepare the crosslinked polyester resin (2):

a diol component shown by: 10 mol %

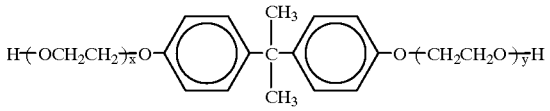

wherein, x+y=2.1, a diol component shown by: 15 mol %

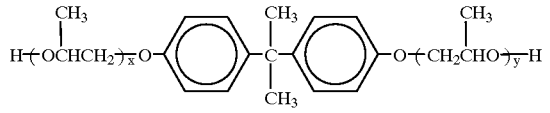

wherein, x+y=2.1, fumaric acid 10 mol %
terephthalic acid 15 mol %
trimellitic acid 0.3 mol %

The nonlinear crosslinked polyester resin (2) thus prepared had a $T_g$ of 56° C., chloroform insoluble matter of 0 wt. %, $M_n$ of 3500 determined by GPC for the THF soluble matter, $M_p$ of 9000, and $M_w/M_n$ of 3.9.

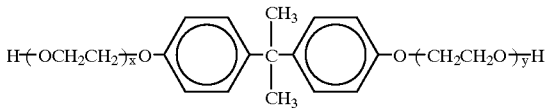

[Preparation Example 3 for Polyester Resin]

A linear prepolymer having a number-average molecular weight ($M_n$) of 920 was prepared by the polycondensation of the following monomers:

a diol component shown by: 30 mol %

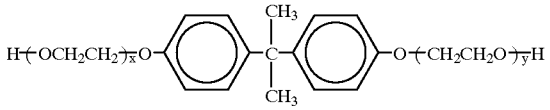

wherein, x+y=2.1, fumaric acid 30 mol %

The prepolymer thus prepared was mixed and polycondensed with the following monomers to prepare the crosslinked polyester resin (3):

a diol component shown by: 20 mol %

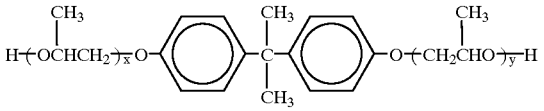

wherein, x+y=2.1,
fumaric acid 10 mol %
terephthalic acid 10 mol % trimellitic acid 0.3 mol %

The crosslinked polyester resin (3) thus prepared had a $T_g$ of 54° C., chloroform insoluble matter of 0 wt. %, $M_n$ of 3100 determined by GPC for the THF soluble matter, $M_p$ of 8000, and $M_w/M_n$ of 3.5.

[Preparation Example 4 for Polyester Resin]

The following monomers were mixed and polycondensed to prepare the nonlinear crosslinked polyester resin (4):

a diol component shown by: 25 mol %

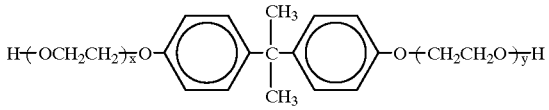

wherein, x+y2.1, a diol component shown by: 25 mol %

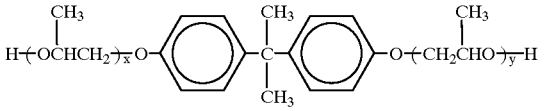

wherein, x+y=2.1,
fumaric acid 50 mol %
terephthalic acid 0 mol %
trimellitic acid 0.1 mol %

The crosslinked polyester resin (4) thus prepared had a $T_g$ of 49° C., chloroform insoluble matter of 0 wt. %, $M_n$ of 2700 determined by GPC for the THF soluble matter, $M_p$ of 5800, and $M_w/M_n$ of 2.8.

[Preparation Example 5 for Polyester Resin]

The following monomers were mixed and polycondensed to prepare the nonlinear crosslinked polyester resin (5):

a diol component shown by: 35 mol %

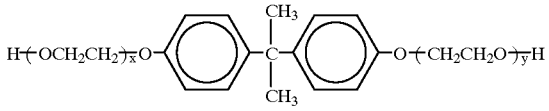

wherein, x+y=2.1, a diol component shown by:

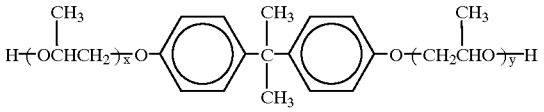

wherein, x+y=2.1, 15 mol %
fumaric acid 35 mol %
terephthalic acid 15 mol %
trimellitic acid 0.3 mol %

The crosslinked polyester resin (5) thus prepared had a $T_g$ of 58° C., chloroform insoluble matter of 0 wt. %, $M_n$ of 3400 determined by GPC for the THF soluble matter, $M_p$ of 9200, and $M_w/M_n$ of 8.0.

[Preparation Example 6 for Polyester Resin]

The following monomers were mixed and polycondensed to prepare the linear polyester resin (6):

a diol component shown by: 15 mol %

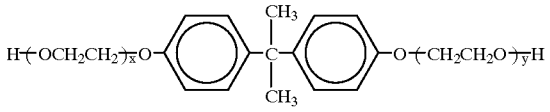

wherein, x+y=2.1, a diol component shown by: 35 mol %

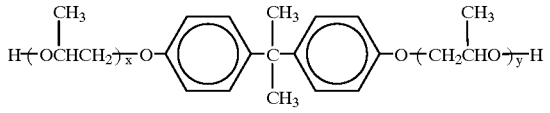

wherein, x+y=2.1, terephthalic acid 48 mol %

The linear polyester resin (6) thus prepared had a $T_g$ of 68° C. chloroform insoluble matter of 0 wt. %, $M_n$ of 5800 determined by GPC for the THF soluble matter, $M_p$ of 14000, and $M_w/M_n$ of 5.2.

[Preparation Example 7 for Polyester Resin]

The following monomers were mixed and polycondensed to prepare the nonlinear crosslinked polyester resin (7):

a diol component shown by: 50 mol %

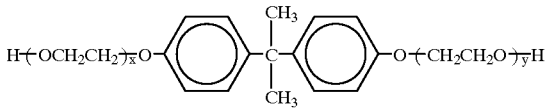

wherein, x+y=2.1, fumaric acid 15 mol % terephthalic acid 35 mol % trimellitic acid 0.6 mol %

The crosslinked polyester resin (7) thus prepared had a $T_g$ of 63° C., chloroform insoluble matter of 14.3 wt. %, $M_n$ of 4800 determined by GPC for the THF soluble matter, $M_p$ of 13000, and $M_w/M_n$ of 19.5.

EXAMPLE 1

The following components put in a kneader type mixer were mixed with each other, and slowly heated under a non-pressurized condition in an open system:

the crosslinked polyester resin (1) 70 parts by weight a cyan pigment paste having a C.I. pigment blue of 15:3 100 parts by weight (pigment solid content: 30 wt. %, water content: 70 wt. %)

The cyan pigment paste had not been subjected to a powdering step after its production.

These components were molten under heating and kneaded for 30 min, after the cyan pigment particles in the aqueous phase were confirmed to be dispersed in, or transferred to, the polyester resin phase when temperature reached 90 to 100° C. Hot water separated after the kneading step was over was discharged from the mixer, and temperature of the mixer was increased to 130° C., at which the polyester resin dispersed with the cyan pigment particles was molten under heating and kneaded for around 30 min, to disperse the particles more homogeneously and, at the same time, to remove water. The mixture was cooled, after the kneading step was over, and crushed to produce the polyester resin powder, 1 mm or smaller in particle diameter, containing the cyan pigment.

The following components were sufficiently pre-mixed by a Henschel mixer, and the mixture was molten/kneaded by a twin screw extruder kept at 100° C.:

the polyester resin powder containing the cyan pigment 16.7 parts by weight (cyan pigment content: 30 wt. %)

the crosslinked polyester resin (1) 88.3 parts by weight a negative charge controlling agent 4 parts by weight (aluminum compound of ditertiary butyl salicylic acid)

The molten/kneaded mixture was at 137 to 139° C., when it was extruded. The cooled mixture was crushed by a hammer mill into coarse particles of around 1 to 2 mm in diameter, and then by an air jet mill into finer particles. These particles were strictly separated into the fine and coarse particles simultaneously by a multi-segment classifier, to produce the cyan toner particle No. 1 (the finer powder). The cyan toner particle No. 1 has a weight-average particle diameter of 7.2 μm, number-average particle diameter of 5.9 μm, and particle diameter distribution of diameter of 4 μm or smaller: 14% by number, diameter of 5.04 μm or smaller: 34% by number, diameter of 8 μm or larger: 29% by volume and diameter of 10.08 μm or larger: 3.5% by volume.

The cyan toner No. 1 was prepared by mixing 100 parts by weight of the cyan toner particle No. 1 with 1.5 parts by weight of the hydrophobic fine alumina powder No. 1 and 0.5 parts by weight of a strontium titanate powder (longitudinal average particle diameter: 1.2 mm, BET specific surface area: 2.3 $m^2/g$). Properties of the cyan toner particle No. 1 and cyan toner No. 1 are given in Tables 3 and 4.

A two-component developer was prepared, to develop magnetic brushes, by mixing 5 parts by weight of the cyan toner No. 1 with 95 parts by weight of magnetic $M_n$—$M_g$—Fe-based ferrite carrier particles, having an average particle diameter of 38 μm and coated with approximately 0.5 wt. % of the resin prepared by reacting a nitrogen-containing cyan coupling agent with a silicone resin.

The copying test with the two-component developer was conducted using a commercial full-color copier (color laser copier 800) for common paper as the transfer medium, after it was modified, to transfer images to common paper. The fixing roller for the copier was 60 mm in diameter, composed of a 5 mm thick aluminum core coated with a 2 mm thick HTV (high temperature vulcanization) type silicone rubber layer, 50 μm thick fluorine rubber layer and 230 μm thick addition type silicone rubber layer, in this order. The press roller was composed of a 5 mm thick aluminum core coated with a 1.5 mm thick HTV (high temperature vulcanization) type silicone rubber layer, 50 um thick fluorine rubber layer and 200 μm thick addition type silicone rubber layer, in this order.

The cyan toner image was fixed on common paper under constant conditions of 155° C. as fixing temperature and 200 mm/sec as fixing speed, while spreading dimethyl silicone oil on the fixing roller.

In order to determine coloring power $D_{0.5}$ of the cyan toner, the cyan color image (gloss: 15%) was formed on common paper by fixing the image with a cyan color dosage MIS adjusted at 0.5 $mg/cm^2$, using an external fixing device having the same roller structure as that for the above copier. Its image density was determined using a color reflecting density meter (X-Rite's X-Rite 404A). The image had a coloring power $D_{0.5}$ of 1.42.

Gloss of the image was determined by a gloss meter (Nippon Denshoku's VG-10), where 3 sheets of white paper were placed one on another on a sample table, on which the fixed image was placed, to read the values (%) shown by a display, after the standard conditions were set using a standard plate (voltage set at 6V by a constant-voltage device, light-emitting and light-receiving angles set at 60°, and zero point adjusted).

The image reproduced under the normal temperature/humidity conditions (23° C. and 60% RH) at a contrast potential of 300V was excellent in color saturation and bright. The cyan-color image was virtually as good as the original one, showing no fogging, after it was durability-tested with 60,000 sheets to which the image was transferred. The cyan color toner was transferred smoothly in the full-color copier, its density was detected well, and the image density was stable. The cyan toner image was transferred to an OHP film, and observed by an overhead projector. The film was highly light-permeable, projecting the bright, cyan-color image on the screen.

The good cyan-color image was also produced under the low temperature/low humidity (15° C. and 10% RH) and high temperature/high humidity (32.5° C. and 85% RH) conditions, confirming its resistance to ambient conditions.

The solid image was formed on both sides of common paper, using a modified color laser copier 800.

The results show that the cyan toner No. 1 has a high coloring power, reducing its required quantity on common paper. Therefore, common paper showed essentially no curl, when an image was fixed thereon once, and moved smoothly in the copier. The solid image (fixed image density: 1.7) was durability-tested by fixing it continuously on both sides of 10,000 sheets of paper. No jam was observed.

The fixed image surface showed no image defects resulting from spreading silicone oil, such as uneven spreading and oil lines. It is therefore considered that the hydrophobic fine alumina powder No. 1 adsorbs silicone oil well.

No silicone oil was detected on the photosensitive and transfer drums after the durability test with a large number of sheets was over, from which it is judged that no or essentially no oil is transferred from the fixed image surface to these drums.

Comparative Example 1

The comparative cyan toner No. 1 was prepared by externally adding to 100 parts by weight of the cyan toner particle No. 1, only 1.5 parts by weight of the hydrophobic fine silica powder, shown in Table 2. Properties of the comparative cyan toner No. 1 are given in Tables 3 and 4. A two-component developer was prepared using the comparative cyan toner No. 1 in a manner similar to that for Example 1, and assessed in a manner also similar to that for Example 1. The assessment results are given in Table 5.

Comparative Example 2

The comparative cyan toner No. 2 was prepared by externally adding to 100 parts by weight of the cyan toner particle No. 1, only 1.5 parts by weight of the hydrophobic fine titanium oxide powder, shown in Table 2. Properties of the comparative cyan toner No. 2 are given in Tables 3 and 4. A two-component developer was prepared using the comparative cyan toner No. 2 in a manner similar to that for Example 1, and assessed in a manner also similar to that for Example 1. The assessment results are given in Table 5.

Comparative Example 3

The comparative cyan toner No. 3 was prepared by externally adding to 100 parts by weight of the cyan toner particle No. 1, 1.5 parts by weight of the hydrophobic fine silica powder and 0.5 parts by weight of the fine strontium titanate powder (longitudinal average particle diameter: 1.2 $\mu$m, BET specific surface area: 2.3 $m^2/g$), shown in Table 2. Properties of the comparative cyan toner No. 3 are given in Tables 3 and 4. A two-component developer was prepared using the comparative cyan toner No. 3 in a manner similar to that for Example 1, and assessed in a manner also similar to that for Example 1. The assessment results are given in Table 5.

Comparative Example 4

The comparative cyan toner No. 4 was prepared by externally adding to 100 parts by weight of the cyan toner particle No. 1, 1.5 parts by weight of the hydrophobic fine titanium oxide powder and 0.5 parts by weight of the fine strontium titanate powder (longitudinal average particle diameter: 1.2 mm, BET specific surface area: 2.3 $m^2/g$), shown in Table 2. Properties of the comparative cyan toner No. 4 are given in Tables 3 and 4. A two-component developer was prepared using the comparative cyan toner No. 4 in a manner similar to that for Example 1, and assessed in a manner also similar to that for Example 1. The assessment results are given in Table 5.

Comparative Examples 5 to 8

The same procedure as used in Example 1 for preparing the toner particle was repeated, except that the crosslinked polyester resin (4), crosslinked polyester resin (5), linear polyester resin (6) and crosslinked polyester resin (7) were used in place of the crosslinked polyester resin (1), to prepare the comparative cyan toner particles No. 1 to No. 4, respectively.

The comparative cyan toners No. 5 to No. 8 were prepared by externally adding to 100 parts by weight of the comparative cyan toner particles No. 1 to No. 4, 1.5 parts by weight of the hydrophobic fine silica powder, shown in Table 2. Properties of the comparative cyan toner particles No. 1 to No. 4, and the comparative cyan toners No. 5 to No. 8 are given in Tables 3 and 4.

Two-component developers were prepared using the comparative cyan toners No. 5 to No. 8 in a manner similar to that for Example 1, and assessed in a manner also similar to that for Example 1. The assessment results are given in Table 5.

Comparative Examples 9 to 12

The comparative cyan toners No. 9 to No. 12 were prepared by externally adding to 100 parts by weight of the comparative cyan toner particles No. 1 to No. 4, 1.5 parts by weight of the hydrophobic fine titanium oxide powder, shown in Table 2. Properties of the comparative cyan toner No. 9 to No. 12 are given in Table 4.

Two-component developers were prepared using the comparative cyan toners No. 9 to No. 12 in a manner similar to that for Example 1, and assessed in a manner also similar to that for Example 1. The assessment results are given in Table 5.

Comparative Example 13

The comparative cyan toner particle No. 5 was prepared using the following components:

| | |
|---|---|
| the crosslinked polyester resin (4) | 100 parts by weight |
| a cyan colorant having a C.I. pigment blue of 15:3 | 5 parts by weight |
| a negative charge controlling agent (aluminum compound of ditertiary butyl salicylic acid), | 4 parts by weight |

which were molten under heating and kneaded, cooled, milled and classified in a manner similar to that for Example 1. The comparative cyan toner No. 13 was prepared using the comparative cyan toner particle No. 5 in a manner similar to that for Example 1, and assessed in a manner also similar to that for Example 1. The assessment results are given in Table 5.

Comparative Examples 14 to 16

The same procedure as used in Comparative Example 13 for preparing the cyan toner particle was repeated, except that the crosslinked polyester resin (5), linear 25 polyester resin (6) and crosslinked polyester resin (7) were used in place of the crosslinked polyester resin (4), to prepare the comparative cyan toner particles No. 6 to No. 8, respectively. The comparative cyan toners No. 14 to No. 16 were prepared using the comparative cyan toner particles No. 6 to No. 8 in a manner similar to that for Example 1, and assessed in a manner also similar to that for Example 1. The assessment results are given in Table 5.

Assessment of Light-Permeability of Image-Fixed OHP

A (good): Good in light-permeability, free of uneven contrast, and excellent in color reproducibility B (average): Slightly uneven contrast observed, although practically causing no problem C (bad): Uneven contrast observed, and insufficient in color reproducibility

[Assessment of Contamination with Silicone Oil by Image Fixation on Both Sides]

A: Free of contamination with silicone oil on the transfer medium carrying sheet on the transfer drum B: Slight contamination with silicone oil observed on the transfer medium sheet carrying on the transfer drum, although practically causing no problem during the transfer process C: Contamination with silicone oil observed on the transfer medium carrying sheets on the transfer drum, to an extent to possibly cause problems during the transfer process

[Assessment of Extent of Curl of Transfer Medium by Image Fixation on One Side]

Extent of curl was assessed by visual observation by the following three grades:

A: Essentially free of curl, causing no problem in transferring common sheets of paper B: Slight curling observed, although practically causing no problem in transferring common sheets of paper C: Curling observed, to an extent to possibly cause problems when an image is formed on the back side of common paper

[Assessment of Durability-Tested Photosensitive Drum Surface]

Surface of the photosensitive drum, after durability test with 60,000 sheets of paper, was assessed by visual observation by the following three grades:

A: Essentially as good as the initial condition

B: Toner-caused filming observed on the photosensitive drum surface in places, although practically causing no problem C: Toner-caused filming observed on the photosensitive drum surface, to an extent to possibly cause defective images

[Assessment of Reproducibility of Highlight Halftone Section]

The fixed images were assessed by visual observation by the following three grades, after the durability test with 60,000 sheets of paper, where the durability-tested sheet was compared with the sheet collected during the initial stage of the test:

A: Good in reproducibility of fine lines, with the halftone section reproduced faithfully B: Smoothness slightly insufficient, although practically causing no problem C: Insufficient in smoothness, with roughness pronounced Assessment of Fogging Fogging was assessed by the following three grades, where whiteness of the white image portions on the sheet collected from the initial stage of the durability test and on the durability-tested sheet were measured by a reflectometer (Tokyo Denshoku's analyzer), to determine fogging density (%) from differences between their whiteness and that of common paper as the transfer medium:

A: Very good, with fogging density below 1.0%

B: Good, with fogging density of 1.0% or higher, but below 2.0%

C: Bad, with fogging density of 2.0% or higher

Comparative Examples 17 to 21

The same procedure as used in Example 1 for preparing the cyan toner particle was repeated, except that milling and classification conditions were changed, to prepare the comparative cyan toner particles No. 9 to No. 13. The comparative cyan toners No. 17 to No. 21 were prepared using the comparative cyan toner particles No. 9 to No. 13 in a manner similar to that for Example 1, and assessed in a manner also similar to that for Example 1. Properties of the comparative cyan toner particles No. 9 to No. 13 and comparative cyan toners No. 17 to No. 21 are given in Tables 6 and 7, respectively. The assessment results are given in Table 8.

EXAMPLES 2 and 3

The same procedure as used in Example 1 for preparing the cyan toner particle was repeated, except that the crosslinked polyester resins (2) and (3) were used in place of the crosslinked polyester resin (1), to prepare the cyan toner particles No. 2 and No. 3, respectively. The cyan toners No. 2 and No. 3 were prepared using the cyan toner particles No. 2 and No. 3 in a manner similar to that for Example 1, and assessed in a manner also similar to that for Example 1. Properties of the cyan toner particles No. 2 and No. 3, and cyan toners No. 2 and No. 3 are given in Tables 6 and 7, respectively. The assessment results are given in Table 8.

EXAMPLES 4 to 6

The same procedure as used in Example 1 was repeated, except that the hydrophobic fine alumina powder No. 2 to No. 4 were used in place of the hydrophobic fine alumina powder No. 1, to prepare the cyan toners No. 4 to No. 6, respectively. The cyan toners No. 4 to No. 6 were assessed in a manner also similar to that for Example 1. Properties of the cyan toners No. 4 to No. 6 are given in Table 7. The assessment results are given in Table 8.

EXAMPLE 7

A polyester resin particle containing a magenta pigment was prepared using the following components, in a manner similar to that for Example 1:

| | |
|---|---|
| the crosslinked polyester resin (1) | 58.3 parts by weight |
| a magenta pigment paste having a C.I. pigment red 122 (pigment solid content: 25 wt. %, water content: 75 wt. %) | 100 parts by weight |

The magenta pigment paste had not been subjected to a powdering step after its production.

The magenta toner particle No. 1 was prepared using the following components, in a manner similar to that for Example 1:

| | |
|---|---|
| the polyester resin particle containing the magenta pigment (magenta pigment content: 30 wt. %) | 20 parts by weight |
| the crosslinked polyester resin (1) | 86 parts by weight |
| a negative charge controlling agent (aluminum compound of ditertiary butyl salicylic acid) | 4 parts by weight |

The magenta toner No. 1 was prepared by mixing 100 parts by weight of the magenta toner particle No. 1 with 1.5 parts by weight of the hydrophobic fine alumina powder No. 1 and 0.5 parts by weight of a strontium titanate powder (longitudinal average particle diameter: 1.2$\mu$m, BET specific surface area: 2.3 $m^2/g$). Properties of the magenta toner particle No. 1 and magenta toner No. 1 are given in Tables 9 and 10.

A two-component developer was prepared, to develop magnetic brushes, by mixing 5 parts by weight of the magenta toner No. 1 with 95 parts by weight of magnetic $M_n$—$M_g$—Fe-based ferrite carrier particles, having an average particle diameter of 38$\mu$m and coated with approximately 1 wt. % of the resin prepared by reacting a nitrogen-containing cyan coupling agent with a silicone resin.

Coloring power $D_{0.5}$ of the two-component developer was determined in a manner similar to that for Example 1. It was 1.32.

The durability test with 30,000 sheets has indicated that image density is stable, reproducibility of the highlight halftone sections is excellent, and light-permeability of the OHP images is also excellent.

The durability test with 10,000 sheets, where images were transferred on both sides, also produced good results. The assessment results are given in Table 11.

EXAMPLES 8 and 9

The same procedure as used in Example 7 for preparing the toner particle was repeated, except that the crosslinked polyester resins (2) and (3) were used in place of the crosslinked polyester resin (1), to prepare the magenta toner particles No. 2 and No. 3, respectively. The magenta toners No. 2 and No. 3 were prepared using the magenta toner particles No. 2 and No. 3 in a manner similar to that for Example 7, and assessed in a manner also similar to that for Example 7. Properties of the magenta toner particles No. 2 and No. 3, and magenta toners No. 2 and No. 3 are given in Tables 9 and 10, respectively. The assessment results are given in Table 11.

Comparative Example 22

The comparative magenta toner No. 1 was prepared by externally adding to 100 parts by weight of the magenta toner particle No. 1, only 1.5 parts by weight of the hydrophobic fine silica powder, shown in Table 2. Properties of the comparative magenta toner No. 1 are given in Tables 9 and 10. A two-component developer was prepared using the comparative magenta toner No. 1 in a manner similar to that for Example 7, and assessed in a manner also similar to that for Example 7. The assessment results are given in Table 11.

Comparative Example 23

The comparative magenta toner No. 2 was prepared by externally adding to 100 parts by weight of the magenta toner particle No. 1, only 1.5 parts by weight of the hydrophobic fine titanium oxide powder, shown in Table 2. Properties of the comparative magenta toner No. 2 are given in Tables 9 and 10. A two-component developer was prepared using the comparative magenta toner No. 2 in a manner similar to that for Example 7, and assessed in a manner also similar to that for Example 7. The assessment results are given in Table 11.

Comparative Examples 24 to 27

The same procedure as used in Example 4 for preparing the toner particle was repeated, except that the crosslinked polyester resin (4), crosslinked polyester resin (5), linear polyester resin (6) and crosslinked polyester resin (7) were used in place of the crosslinked polyester resin (1), to prepare the comparative magenta toner particles No. 1 to No. 4, respectively.

The comparative magenta toners No. 3 to No. 6 were prepared by externally adding to 100 parts by weight of the comparative magenta toner particles No. 1 to No. 4, 1.5 parts by weight of the hydrophobic fine silica powder, shown in Table 2. Properties of the comparative magenta toner particles No. 1 to No. 4, and the comparative magenta toners No. 3 to No. 6 are given in Tables 9 and 10.

Two-component developers were prepared using the comparative magenta toners No. 3 to No. 6 in a manner similar to that for Example 7, and assessed in a manner similar to that for Example 4. The assessment results are given in Table 11.

Comparative Examples 28 to 31

The comparative magenta toners No. 7 to No. 10 were prepared by externally adding to 100 parts by weight of the comparative magenta toner particles No. 1 to No. 4, 1.5 parts by weight of the hydrophobic fine titanium oxide powder, shown in Table 2. Properties of the comparative magenta toners No. 7 to No. 10 are given in Tables 9 and 10.

Two-component developers were prepared using the comparative magenta toners No. 7 to No. 10 in a manner similar to that for Example 7, and assessed in a manner also similar to that for Example 7. The assessment results are given in Table 11.

Comparative Example 32

The comparative magenta toner particle No. 5 was prepared using the following components:

| | |
|---|---|
| the crosslinked polyester resin (4) | 100 parts by weight |
| a magenta colorant having a C.I. pigment red 122 | 6 parts by weight |
| a negative charge controlling agent | 4 parts by weight |

-continued

| | |
|---|---|
| (aluminum compound of ditertiary butyl salicylic acid), | |

which were molten under heating and kneaded, cooled, milled and classified in a manner similar to that for Example 4. The comparative magenta toner No. 11 was prepared using the comparative magenta toner particle No. 5 in a manner similar to that for Example 7, and assessed in a manner also similar to that for Example 7. The assessment results are given in Table 11.

Example 10

A polyester resin particle containing a yellow pigment was prepared using the following components, in a manner similar to that for Example 1:

| | |
|---|---|
| the crosslinked polyester resin (1) | 100 parts by weight |
| a yellow pigment paste having a C.I. pigment yellow 17 (pigment solid content: 20 wt. %, water content: 80 wt. %) | 100 parts by weight |

The yellow pigment paste had not been subjected to a powdering step after its production.

The yellow toner particle No. 1 was prepared using the following components, in a manner similar to that for Example 1:

| | |
|---|---|
| the polyester resin particle containing the yellow pigment (yellow pigment content: 20 wt. %) | 20 parts by weight |
| the crosslinked polyester resin (1) | 84 parts by weight |
| a negative charge controlling agent (aluminum compound of ditertiary butyl salicylic acid) | 4 parts by weight |

The yellow toner No. 1 was prepared by mixing 100 parts by weight of the yellow toner particle No. 1 with 1.5 parts by weight of the hydrophobic fine alumina powder No. 1 and 0.5 parts by weight of a strontium titanate powder (longitudinal average particle diameter: 1.2 $\mu$m, BET specific surface area: 2.3 $m^2/g$). Properties of the yellow toner particle No. 1 and yellow toner No. 1 are given in Tables 12 and 13.

A two-component developer was prepared, to develop magnetic brushes, by mixing 5 parts by weight of the yellow toner No. 1 with 95 parts by weight of magnetic $M_n$—$M_g$—Fe-based ferrite carrier particles, having an average diameter of 38 $\mu$m and coated with approximately 1 wt. % of the resin prepared by reacting a nitrogen-containing cyan coupling agent with a silicone resin.

Coloring power $D_{0.5}$ of the two-component developer was determined in a manner similar to that for Example 1. It was 1.45.

The durability test with 30,000 sheets indicated that image density was stable, reproducibility of the highlight halftone sections was excellent, and light-permeability of the OHP images was also excellent.

The durability test with 10,000 sheets, where images were transferred on both sides, also produced good results. The assessment results are given in Table 14.

EXAMPLES 11 and 12

The same procedure as used in Example 10 for preparing the toner particle was repeated, except that the crosslinked polyester resins (2) and (3) were used in place of the crosslinked polyester resin (1), to prepare the yellow toner particles No. 2 and No. 3, respectively. The yellow toners No. 2 and No. 3 were prepared using the yellow toner particles No. 2 and No. 3 in a manner similar to that for Example 10, and assessed in a manner also similar to that for Example 10. Properties of the yellow toner particles No. 2 and No. 3, and yellow toners No. 2 and No. 3 are given in Tables 12 and 13, respectively. The assessment results are given in Table 14.

Comparative Example 33

The comparative yellow toner No. 1 was prepared by externally adding to 100 parts by weight of the yellow toner particle No. 1, only 1.5 parts by weight of the hydrophobic fine silica powder, shown in Table 2. Properties of the comparative yellow toner No. 1 are given in Tables 12 and 13. A two-component developer was prepared using the comparative yellow toner No. 1 in a manner similar to that for Example 10, and assessed in a manner also similar to that for Example 10. The assessment results are given in Table 14.

Comparative Example 34

The comparative yellow toner No. 2 was prepared by externally adding to 100 parts by weight of the yellow toner particle No. 1, only 1.5 parts by weight of the hydrophobic fine titanium oxide powder, shown in Table 2. Properties of the comparative yellow toner No. 2 are given in Tables 12 and 13. A two-component developer was prepared using the comparative yellow toner No. 2 in a manner similar to that for Example 10, and assessed in a manner also similar to that for Example 10. The assessment results are given in Table 14.

Comparative Examples 35 to 38

The same procedure as used in Example 10 for preparing the toner particle was repeated, except that the crosslinked polyester resin (4), crosslinked polyester resin (5), linear polyester resin (6) and crosslinked polyester resin (7) were used in place of the crosslinked polyester resin (1), to prepare the comparative yellow toner particles No. 1 to No. 4, respectively.

The comparative yellow toners No. 3 to No. 6 were prepared by externally adding to 100 parts by weight of the comparative yellow toner particles No. 1 to No. 4, 1.5 parts by weight of the hydrophobic fine silica powder, shown in Table 2. Properties of the comparative yellow toner particles No. 1 to No. 4, and the comparative yellow toners No. 3 to No. 6 are given in Tables 12 and 13.

Two-component developers were prepared using the comparative yellow toners No. 3 to No. 6 in a manner similar to that for Example 10, and assessed in a manner similar to that for Example 4. The assessment results are given in Table 14.

Comparative Examples 39 to 42

The comparative yellow toners No. 7 to No. 10 were prepared by externally adding to 100 parts by weight of the comparative yellow toner particles No. 1 to No. 4, 1.5 parts by weight of the hydrophobic fine titanium oxide powder, shown in Table 2. Properties of the comparative yellow toners No. 7 to No. 10 are given in Tables 12 and 13.

Two-component developers were prepared using the comparative yellow toners No. 7 to No. 10 in a manner similar to that for Example 10, and assessed in a manner also similar to that for Example 10. The assessment results are given in Table 14.

Comparative Example 43

The comparative yellow toner particle No. 5 was prepared using the following components:

| | |
|---|---|
| the crosslinked polyester resin (4) | 100 parts by weight |
| a magenta colorant having a C.I. pigment yellow 17 | 4 parts by weight |
| a negative charge controlling agent (aluminum compound of ditertiary butyl salicylic acid), | 4 parts by weight |

which were molten under heating and kneaded, cooled, milled and classified in a manner similar to that for Example 10. The comparative yellow toner No. 11 was prepared using the comparative yellow toner particle No. 5 in a manner similar to that for Example 10, and assessed in a manner also similar to that for Example 10. The assessment results are given in Table 14.

EXAMPLE 13

Image forming tests were conducted with the two-component developers containing the cyan toner No. 1, magenta toner No. 1 and yellow toner No. 1, prepared respectively in Examples 1, 7 and 10, in a full color mode using the full-color copier described in Example 1, where the full-color images were fixed on both sides of common sheets of paper (transfer media). These full-color images were of high quality, when compared with the original ones. Results of the durability tests with a large number of transfer media to which the images were transferred also showed that the transfer medium carrying sheets on the transfer drum were little contaminated with silicone oil; the transfer media were little curled, and image-carrying media moved smoothly in the copier; the images fixed on both sides of the media showed no defects; no media wrapped on the rollers; and no offset phenomenon was observed.

The full-color images formed on OHP films were excellent in light-permeability, and projected on a screen to show the clear images. The assessment results are given in Table 15.

Comparative Example 44

The image forming tests were conducted in a full color mode in a manner similar to that for Example 13 with the two-component developers containing the comparative cyan toner No. 1, comparative magenta toner No. 1 and comparative yellow toner No. 1, prepared respectively in Comparative Examples 1, 22, and 33. The assessment results are given in Table 15.

Comparative Example 45

The image forming tests were conducted in a full color mode in a manner similar to that for Example 13 with the two-component developers containing the comparative cyan toner No. 2, comparative magenta toner No. 2 and comparative yellow toner No. 2, prepared respectively in Comparative Examples 2, 23, and 34. The assessment results are given in Table 15.

Comparative Example 46

The image forming tests were conducted in a full color mode in a manner similar to that for Example 13 with the two-component developers containing the comparative cyan toner No. 5, comparative magenta toner No. 3 and comparative yellow toner No. 3, prepared respectively in Comparative Examples 5, 24, and 35. The assessment results are given in Table 15.

Comparative Example 47

The image forming tests were conducted in a full color mode in a manner similar to that for Example 13 with the two-component developers containing the comparative cyan toner No. 6, comparative magenta toner No. 4 and comparative yellow toner No. 4, prepared respectively in Comparative Examples 6, 25, and 36. The assessment results are given in Table 15.

Comparative Example 48

The image forming tests were conducted in a full color mode in a manner similar to that for Example 13 with the two-component developers containing the comparative cyan toner No. 7, comparative magenta toner No. 5 and comparative yellow toner No. 5, prepared respectively in Comparative Examples 7, 26, and 37. The assessment results are given in Table 15.

Comparative Example 49

The image forming tests were conducted in a full color mode in a manner similar to that for Example 13 with the two-component developers containing the comparative cyan toner No. 8, comparative magenta toner No. 6 and comparative yellow toner No. 6, prepared respectively in Comparative Examples 8, 27, and 38. The assessment results are given in Table 15.

TABLE 3

| | Weight average particle diameter (μm) | Number average particle diameter (μm) | Toner particle with particle diameter of not more than 4 μm (% by number) | Toner particle with particle diameter of not more than 5.04 μm (% by number) | Toner particle with particle diameter of not less than 8 μm (% by volume) | Toner particle with particle diameter of not less than 10.08 μm (% by volume) | Chloroform insoluble matter (mg/1 g) |
|---|---|---|---|---|---|---|---|
| Cyan toner particle No. 1 | 7.2 | 5.9 | 14 | 34 | 29 | 3.5 | 8.0 |
| Comparative cyan toner particle No. 1 | 7.0 | 5.8 | 15 | 36 | 24 | 3.0 | 8.5 |
| Comparative cyan toner particle No. 2 | 6.9 | 5.7 | 19 | 37 | 24 | 2.0 | 7.9 |
| Comparative cyan toner particle No. 3 | 7.1 | 5.9 | 16 | 35 | 30 | 2.9 | 7.5 |
| Comparative cyan toner particle No. 4 | 7.1 | 5.8 | 16 | 34 | 30 | 3.3 | 26.5 |

TABLE 3-continued

| | Weight average particle diameter (μm) | Number average particle diameter (μm) | Toner particle with particle diameter of not more than 4 μm (% by number) | Toner particle with particle diameter of not more than 5.04 μm (% by number) | Toner particle with particle diameter of not less than 8 μm (% by volume) | Toner particle with particle diameter of not less than 10.08 μm (% by volume) | Chloroform insoluble matter (mg/1 g) |
|---|---|---|---|---|---|---|---|
| Comparative cyan toner particle No. 5 | 7.4 | 6.0 | 18 | 41 | 35 | 5.6 | 15.2 |
| Comparative cyan toner particle No. 6 | 7.3 | 5.9 | 15 | 40 | 33 | 5.2 | 13.5 |
| Comparative cyan toner particle No. 7 | 7.1 | 6.0 | 18 | 40 | 30 | 5.1 | 14.3 |
| Comparative cyan toner particle No. 8 | 7.3 | 6.1 | 17 | 40 | 30 | 5.1 | 30.8 |

TABLE 4

| | Weight average particle diameter (μm) | Number average particle diameter (μm) | Toner particle with particle diameter of not more than 4 μm (% by number) | Toner particle with particle diameter of not more than 5.04 μm (% by number) | Toner particle with particle diameter of not less than 8 μm (% by volume) | Toner particle with particle diameter of not less than 10.08 μm (% by volume) |
|---|---|---|---|---|---|---|
| Cyan toner No. 1 | 7.2 | 5.9 | 14 | 34 | 29 | 3.5 |
| Comparative cyan toner No. 1 | 7.1 | 5.8 | 13 | 33 | 29 | 3.4 |
| Comparative cyan toner No. 2 | 7.1 | 5.9 | 13 | 33 | 28 | 3.5 |
| Comparative cyan toner No. 3 | 7.2 | 5.8 | 13 | 34 | 29 | 3.5 |
| Comparative cyan toner No. 4 | 7.2 | 5.9 | 14 | 33 | 28 | 3.4 |
| Comparative cyan toner No. 5 | 7.0 | 5.8 | 16 | 35 | 25 | 2.9 |
| Comparative cyan toner No. 6 | 6.9 | 5.7 | 18 | 38 | 25 | 1.9 |
| Comparative cyan toner No. 7 | 7.1 | 5.9 | 15 | 34 | 29 | 2.9 |
| Comparative cyan toner No. 8 | 7.1 | 5.8 | 16 | 35 | 30 | 3.4 |
| Comparative cyan toner No. 9 | 7.0 | 5.8 | 15 | 35 | 25 | 2.9 |
| Comparative cyan toner No. 10 | 6.9 | 5.9 | 18 | 38 | 25 | 2.0 |
| Comparative cyan toner No. 11 | 7.1 | 5.9 | 15 | 34 | 29 | 3.0 |
| Comparative cyan toner No. 12 | 7.1 | 5.8 | 15 | 34 | 30 | 3.5 |
| Comparative cyan toner No. 13 | 7.4 | 6.0 | 17 | 42 | 36 | 5.5 |
| Comparative cyan toner No. 14 | 7.2 | 5.9 | 16 | 39 | 32 | 5.1 |
| Comparative cyan toner No. 15 | 7.1 | 5.9 | 15 | 38 | 29 | 5.0 |
| Comparative cyan toner No. 16 | 7.3 | 6.0 | 16 | 40 | 31 | 5.0 |

TABLE 5

| | | | | | Normal temperature/normal humidity environment | | | | | |
|---|---|---|---|---|---|---|---|---|---|---|
| | | | | | Initial stage | | | After copying 60,000 sheets | | |
| | $G'_{130}$ (dyn/cm$^2$) | $G'_{170}$ (dyn/cm$^2$) | $G'_{170}/G'_{130}$ | $D_{0.5}$ | Image density | Fog-ging | Reproducibility of highlight portion | Image density | Fog-ging | Reproducibility of highlight portion |
| Example No. 1 | $8 \times 10^3$ | $1 \times 10^4$ | 1.25 | 1.42 | 1.72 | A | A | 1.70 | A | A |
| Comparative Example No. 1 | $8 \times 10^3$ | $1 \times 10^4$ | 1.25 | 1.41 | 1.62 | A | A | 1.40 | C | C |
| Comparative Example No. 2 | $8 \times 10^3$ | $1 \times 10^4$ | 1.25 | 1.40 | 1.70 | A | A | 1.55 | B | C |
| Comparative Example No. 3 | $8 \times 10^3$ | $1 \times 10^4$ | 1.25 | 1.41 | 1.63 | A | A | 1.44 | C | B |
| Comparative Example No. 4 | $8 \times 10^3$ | $1 \times 10^4$ | 1.25 | 1.40 | 1.70 | A | A | 1.58 | B | B |
| Comparative Example No. 5 | $6 \times 10^3$ | $6 \times 10^2$ | 0.10 | 1.38 | 1.82 | B | B | 1.62 | C | C |
| Comparative Example No. 6 | $5 \times 10^4$ | $3 \times 10^4$ | 0.60 | 1.30 | 1.65 | A | A | 1.52 | C | C |
| Comparative Example No. 7 | $7 \times 10^4$ | $6 \times 10^3$ | 0.07 | 1.29 | 1.60 | A | A | 1.50 | C | C |
| Comparative Example No. 8 | $2 \times 10^5$ | $5 \times 10^4$ | 0.25 | 1.01 | 1.40 | A | A | 1.32 | C | C |
| Comparative Example No. 9 | $6 \times 10^3$ | $6 \times 10^2$ | 0.10 | 1.38 | 1.80 | A | B | 1.65 | C | C |
| Comparative Example No. 10 | $5 \times 10^4$ | $3 \times 10^4$ | 0.60 | 1.31 | 1.66 | A | A | 1.59 | B | B |
| Comparative Example No. 11 | $7 \times 10^4$ | $6 \times 10^3$ | 0.09 | 1.29 | 1.64 | A | A | 1.58 | B | B |
| Comparative Example No. 12 | $2 \times 10^5$ | $5 \times 10^4$ | 0.25 | 1.01 | 1.40 | A | A | 1.38 | B | B |
| Comparative Example No. 13 | $6 \times 10^3$ | $6 \times 10^2$ | 0.10 | 1.18 | 1.67 | A | A | 1.51 | C | C |
| Comparative Example No. 14 | $5 \times 10^4$ | $3 \times 10^4$ | 0.60 | 1.10 | 1.51 | A | A | 1.40 | B | A |
| Comparative Example No. 15 | $7 \times 10^4$ | $6 \times 10^3$ | 0.09 | 1.08 | 1.49 | A | A | 1.40 | C | A |
| Comparative Example No. 16 | $1 \times 10^5$ | $4 \times 10^4$ | 0.40 | 0.92 | 1.32 | A | A | 1.23 | B | A |

TABLE 5-continued

| | Light-permeability of OHP fixing image | Both surfaces fixation operation: Contamination of silicone oil | Both surfaces fixation operation: Occurrence of curl | Photosensitive drum surface appearance after running test |
|---|---|---|---|---|
| Example No. 1 | A | A | A | A |
| Comparative Example No. 1 | A | C | A | C |
| Comparative Example No. 2 | A | C | A | C |
| Comparative Example No. 3 | A | C | A | B |
| Comparative Example No. 4 | A | C | A | B |
| Comparative Example No. 5 | A | C | C | C |
| Comparative Example No. 6 | B | C | B | B |
| Comparative Example No. 7 | C | C | A | B |
| Comparative Example No. 8 | C | B | A | B |
| Comparative Example No. 9 | A | C | C | C |
| Comparative Example No. 10 | B | C | B | B |
| Comparative Example No. 11 | C | C | A | A |
| Comparative Example No. 12 | C | B | A | A |
| Comparative Example No. 13 | B | B | C | C |
| Comparative Example No. 14 | C | A | B | B |
| Comparative Example No. 15 | C | A | A | B |
| Comparative Example No. 16 | C | A | A | B |

TABLE 6

| | Weight average particle diameter (μm) | Number average particle diameter (μm) | Toner particle with particle diameter of not more than 4 μm (% by number) | Toner particle with particle diameter of not more than 5.04 μm (% by number) | Toner particle with particle diameter of not less than 8 μm (% by volume) | Toner particle with particle diameter of not less than 10.08 μm (% by volume) | Chloroform insoluble matter (mg/1 g) |
|---|---|---|---|---|---|---|---|
| Cyan toner particle No. 1 | 7.2 | 5.9 | 14 | 34 | 29 | 3.5 | 8.0 |
| Comparative cyan toner particle No. 9 | 9.1 | 6.9 | 8 | 23 | 56 | 24 | 8.3 |
| Comparative cyan toner particle No. 10 | 9.8 | 7.6 | 0 | 12 | 72 | 36 | 8.6 |
| Comparative cyan toner particle No. 11 | 4.9 | 4.5 | 39 | 70 | 0 | 0 | 7.4 |
| Comparative cyan toner particle No. 12 | 7.5 | 6.2 | 3 | 24 | 36 | 5.5 | 7.6 |
| Comparative cyan toner particle No. 13 | 8.3 | 6.3 | 11 | 29 | 46 | 15 | 8.0 |
| Cyan toner particle No. 2 | 7.4 | 6.0 | 17 | 42 | 35 | 5.4 | 8.2 |
| Cyan toner particle No. 3 | 7.0 | 5.8 | 15 | 38 | 29 | 3.3 | 9.5 |

TABLE 7

| | Weight average particle diameter (μm) | Number average particle diameter (μm) | Toner particle with particle diameter of not more than 4 μm (% by number) | Toner particle with particle diameter of not more than 5.04 μm (% by number) | Toner particle with particle diameter of not less than 8 μm (% by volume) | Toner particle with particle diameter of not less than 10.08 μm (% by volume) |
|---|---|---|---|---|---|---|
| Cyan toner No. 1 | 7.2 | 5.9 | 14 | 34 | 29 | 3.5 |
| Comparative cyan toner No. 17 | 9.1 | 6.9 | 8 | 20 | 58 | 25 |
| Comparative cyan toner No. 18 | 9.8 | 7.6 | 0 | 10 | 74 | 38 |
| Comparative cyan toner No. 19 | 4.9 | 4.5 | 40 | 72 | 0 | 0 |
| Comparative cyan toner No. 20 | 7.6 | 6.2 | 2 | 25 | 35 | 5.8 |
| Comparative cyan toner No. 21 | 8.3 | 6.3 | 12 | 32 | 46 | 17 |
| Cyan toner No. 2 | 7.4 | 6.1 | 18 | 43 | 36 | 5.6 |
| Cyan toner No. 3 | 7.1 | 5.9 | 17 | 39 | 30 | 3.5 |
| Cyan toner No. 4 | 7.2 | 5.9 | 15 | 35 | 30 | 3.6 |
| Cyan toner No. 5 | 7.2 | 5.9 | 16 | 36 | 30 | 3.6 |
| Cyan toner No. 6 | 7.1 | 5.8 | 14 | 35 | 29 | 3.5 |

TABLE 8

| | | | | | Normal temperature/normal humidity environment | | | | | |
|---|---|---|---|---|---|---|---|---|---|---|
| | | | | | Initial stage | | | After copying 60,000 sheets | | |
| | $G'_{130}$ (dyn/cm$^2$) | $G'_{170}$ (dyn/cm$^2$) | $G'_{170}/G'_{130}$ | $D_{0.5}$ | Image density | Fog-ging | Reproducibility of highlight portion | Image density | Fog-ging | Reproducibility of highlight portion |
| Example No. 1 | $8 \times 10^3$ | $1 \times 10^4$ | 1.25 | 1.42 | 1.72 | A | A | 1.70 | A | A |
| Comparative Example No. 17 | $8 \times 10^3$ | $1 \times 10^4$ | 1.25 | 1.15 | 1.72 | A | B | 1.65 | A | C |
| Comparative Example No. 18 | $8 \times 10^3$ | $1 \times 10^4$ | 1.25 | 1.02 | 1.75 | A | B | 1.65 | A | C |
| Comparative Example No. 19 | $8 \times 10^3$ | $1 \times 10^4$ | 1.25 | 1.52 | 1.38 | B | B | 1.02 | C | C |
| Comparative Example No. 20 | $8 \times 10^3$ | $1 \times 10^4$ | 1.25 | 1.31 | 1.65 | A | B | 1.45 | B | C |
| Comparative Example No. 21 | $8 \times 10^3$ | $1 \times 10^4$ | 1.25 | 1.25 | 1.60 | A | B | 1.40 | C | C |
| Example No. 2 | $9 \times 10^3$ | $2 \times 10^4$ | 2.22 | 1.39 | 1.69 | A | A | 1.65 | A | A |
| Example No. 3 | $1 \times 10^4$ | $1 \times 10^4$ | 1.00 | 1.40 | 1.70 | A | A | 1.68 | A | A |
| Example No. 4 | $8 \times 10^3$ | $1 \times 10^4$ | 1.25 | 1.42 | 1.70 | A | A | 1.65 | B | B |
| Example No. 5 | $8 \times 10^3$ | $1 \times 10^4$ | 1.25 | 1.42 | 1.70 | A | A | 1.69 | A | A |
| Example No. 6 | $8 \times 10^3$ | $1 \times 10^4$ | 1.25 | 1.42 | 1.56 | B | B | 1.50 | B | B |

| | | Both surfaces fixation operation | | |
|---|---|---|---|---|
| | Light-permeability of OHP fixing image | Contamination of silicone oil | Occurrence of curl | Photosensitive drum surface appearance after running test |
| Example No. 1 | A | A | A | A |
| Comparative Example No. 17 | A | B | B | A |
| Comparative Example No. 18 | B | B | C | A |
| Comparative Example No. 19 | B | A | A | B |
| Comparative Example No. 20 | A | A | B | A |
| Comparative Example No. 21 | A | A | B | A |
| Example No. 2 | A | A | A | A |
| Example No. 3 | A | A | A | A |
| Example No. 4 | A | B | A | B |
| Example No. 5 | A | A | A | A |
| Example No. 6 | B | B | B | B |

TABLE 9

| | Weight average particle diameter ($\mu$m) | Number average particle diameter ($\mu$m) | Toner particle with particle diameter of not more than 4 $\mu$m (% by number) | Toner particle with particle diameter of not more than 5.04 $\mu$m (% by number) | Toner particle with particle diameter of not less than 8 $\mu$m (% by volume) | Toner particle with particle diameter of not less than 10.08 $\mu$m (% by volume) | Chloroform insoluble matter (mg/1 g) |
|---|---|---|---|---|---|---|---|
| Magenta toner particle No. 1 | 7.0 | 5.8 | 14 | 33 | 26 | 3.0 | 6.5 |
| Magenta toner particle No. 2 | 6.9 | 5.7 | 15 | 34 | 24 | 3.1 | 6.3 |
| Magenta toner particle No. 3 | 7.2 | 5.9 | 14 | 33 | 25 | 3.1 | 6.8 |
| Comparative magenta toner particle No. 1 | 7.1 | 5.9 | 15 | 36 | 30 | 3.8 | 6.6 |
| Comparative magenta toner particle No. 2 | 7.0 | 6.0 | 14 | 35 | 29 | 4.2 | 7.4 |
| Comparative magenta toner particle No. 3 | 7.0 | 5.9 | 19 | 39 | 30 | 3.7 | 7.2 |
| Comparative magenta toner particle No. 4 | 7.1 | 5.8 | 20 | 40 | 24 | 3.1 | 8.1 |
| Comparative magenta toner particle No. 5 | 7.0 | 5.9 | 18 | 35 | 29 | 4.2 | 21.3 |

TABLE 10

| | Weight average particle diameter (μm) | Number average particle diameter (μm) | Toner particle with particle diameter of not more than 4 μm (% by number) | Toner particle with particle diameter of not more than 5.04 μm (% by number) | Toner particle with particle diameter of not less than 8 μm (% by volume) | Toner particle with particle diameter of not less than 10.08 μm (% by volume) |
|---|---|---|---|---|---|---|
| Magenta toner No. 1 | 7.0 | 5.8 | 13 | 32 | 25 | 3.0 |
| Magenta toner No. 2 | 6.8 | 5.7 | 15 | 35 | 22 | 3.0 |
| Magenta toner No. 3 | 7.2 | 5.9 | 12 | 32 | 24 | 3.1 |
| Comparative magenta toner No. 1 | 7.0 | 5.8 | 13 | 32 | 25 | 3.0 |
| Comparative magenta toner No. 2 | 7.0 | 5.8 | 14 | 33 | 26 | 3.2 |
| Comparative magenta toner No. 3 | 7.1 | 5.9 | 15 | 36 | 30 | 3.9 |
| Comparative magenta toner No. 4 | 7.0 | 6.0 | 15 | 35 | 30 | 4.1 |
| Comparative magenta toner No. 5 | 7.0 | 5.9 | 18 | 40 | 30 | 3.5 |
| Comparative magenta toner No. 6 | 7.1 | 5.9 | 19 | 39 | 25 | 3.0 |
| Comparative magenta toner No. 7 | 7.1 | 6.0 | 15 | 38 | 32 | 3.8 |
| Comparative magenta toner No. 8 | 7.0 | 5.8 | 16 | 35 | 32 | 3.4 |
| Comparative magenta toner No. 9 | 7.0 | 6.1 | 18 | 39 | 32 | 3.7 |
| Comparative magenta toner No. 10 | 7.0 | 5.9 | 19 | 39 | 29 | 3.3 |
| Comparative magenta toner No. 11 | 7.0 | 6.0 | 15 | 38 | 28 | 4.0 |

TABLE 11

| | | | | | Normal temperature/normal humidity environment | | | | | |
|---|---|---|---|---|---|---|---|---|---|---|
| | | | | | Initial stage | | | After copying 30,000 sheets | | |
| | $G'_{130}$ (dyn/cm$^2$) | $G'_{170}$ (dyn/cm$^2$) | $G'_{170}/G'_{130}$ | $D_{0.5}$ | Image density | Fog-ging | Reproducibility of highlight portion | Image density | Fog-ging | Reproducibility of highlight portion |
| Example No. 7 | $9 \times 10^3$ | $2 \times 10^4$ | 2.22 | 1.32 | 1.68 | A | A | 1.65 | A | A |
| Example No. 8 | $1 \times 10^4$ | $3 \times 10^4$ | 3.00 | 1.29 | 1.64 | A | A | 1.62 | A | A |
| Example No. 9 | $2 \times 10^4$ | $2 \times 10^4$ | 1.00 | 1.30 | 1.65 | A | A | 1.64 | A | A |
| Comparative Example No. 22 | $9 \times 10^3$ | $2 \times 10^4$ | 2.22 | 1.32 | 1.58 | A | A | 1.49 | C | C |
| Comparative Example No. 23 | $9 \times 10^3$ | $2 \times 10^4$ | 2.22 | 1.31 | 1.59 | A | A | 1.55 | B | C |
| Comparative Example No. 24 | $7 \times 10^3$ | $6 \times 10^2$ | 0.09 | 1.29 | 1.64 | B | B | 1.52 | C | C |
| Comparative Example No. 25 | $5 \times 10^4$ | $3 \times 10^4$ | 0.60 | 1.28 | 1.60 | A | A | 1.48 | C | C |
| Comparative Example No. 26 | $7 \times 10^4$ | $6 \times 10^3$ | 0.09 | 1.25 | 1.59 | A | A | 1.50 | C | C |
| Comparative Example No. 27 | $2 \times 10^5$ | $5 \times 10^4$ | 2.50 | 0.99 | 1.38 | A | A | 1.28 | C | C |
| Comparative Example No. 28 | $7 \times 10^3$ | $6 \times 10^2$ | 0.09 | 1.29 | 1.65 | B | C | 1.62 | C | C |
| Comparative Example No. 29 | $5 \times 10^4$ | $3 \times 10^4$ | 0.60 | 1.27 | 1.62 | A | B | 1.60 | B | B |
| Comparative Example No. 30 | $7 \times 10^4$ | $6 \times 10^3$ | 0.09 | 1.25 | 1.61 | A | B | 1.58 | B | B |
| Comparative Example No. 31 | $2 \times 10^5$ | $6 \times 10^4$ | 2.50 | 1.00 | 1.37 | A | B | 1.30 | B | B |
| Comparative Example No. 32 | $7 \times 10^3$ | $6 \times 10^2$ | 0.09 | 1.08 | 1.58 | A | B | 1.31 | C | C |

| | | Both surfaces fixation operation | | |
|---|---|---|---|---|
| | Light-permeability of OHP fixing image | Contamination of silicone oil | Occurrence of curl | Photosensitive drum surface appearance after running test |
| Example No. 7 | A | A | A | A |
| Example No. 8 | A | A | A | A |
| Example No. 9 | A | A | A | A |
| Comparative Example No. 22 | A | C | A | C |
| Comparative Example No. 23 | A | C | A | C |
| Comparative Example No. 24 | A | C | C | C |
| Comparative Example No. 25 | B | C | B | B |
| Comparative Example No. 26 | C | C | A | B |
| Comparative Example No. 27 | C | B | A | B |
| Comparative Example No. 28 | A | C | C | C |
| Comparative Example No. 29 | B | C | B | B |
| Comparative Example No. 30 | C | C | A | A |
| Comparative Example No. 31 | C | B | A | A |
| Comparative Example No. 32 | C | B | C | C |

TABLE 12

| | Weight average particle diameter (μm) | Number average particle diameter (μm) | Toner particle with particle diameter of not more than 4 μm (% by number) | Toner particle with particle diameter of not more than 5.04 μm (% by number) | Toner particle with particle diameter of not less than 8 μm (% by volume) | Toner particle with particle diameter of not less than 10.08 μm (% by volume) | Chloroform insoluble matter (mg/1 g) |
|---|---|---|---|---|---|---|---|
| Yellow toner particle No. 1 | 6.8 | 5.4 | 23 | 39 | 17 | 3.2 | 9.8 |
| Yellow toner particle No. 2 | 7.0 | 5.6 | 20 | 38 | 22 | 3.5 | 9.5 |
| Yellow toner particle No. 3 | 7.0 | 5.5 | 19 | 40 | 22 | 2.9 | 10.2 |
| Comparative yellow toner particle No. 1 | 6.8 | 5.4 | 22 | 41 | 19 | 2.1 | 9.8 |
| Comparative yellow toner particle No. 2 | 6.9 | 5.5 | 19 | 40 | 23 | 2.4 | 8.2 |
| Comparative yellow toner particle No. 3 | 7.0 | 5.6 | 21 | 38 | 22 | 2.7 | 9.7 |
| Comparative yellow toner particle No. 4 | 7.0 | 5.6 | 20 | 38 | 21 | 3.0 | 8.8 |
| Comparative yellow toner particle No. 5 | 6.8 | 5.4 | 22 | 38 | 22 | 4.2 | 20.4 |

TABLE 13

| | Weight average particle diameter (μm) | Number average particle diameter (μm) | Toner particle with particle diameter of not more than 4 μm (% by number) | Toner particle with particle diameter of not more than 5.04 μm (% by number) | Toner particle with particle diameter of not less than 8 μm (% by volume) | Toner particle with particle diameter of not less than 10.08 μm (% by volume) |
|---|---|---|---|---|---|---|
| Yellow toner No. 1 | 6.9 | 5.5 | 23 | 39 | 18 | 3.5 |
| Yellow toner No. 2 | 7.0 | 5.6 | 20 | 37 | 24 | 3.2 |
| Yellow toner No. 3 | 6.9 | 5.6 | 22 | 40 | 23 | 3.1 |
| Comparative yellow toner No. 1 | 6.9 | 5.5 | 23 | 40 | 20 | 3.4 |
| Comparative yellow toner No. 2 | 6.9 | 5.5 | 22 | 41 | 19 | 3.2 |
| Comparative yellow toner No. 3 | 6.8 | 5.4 | 23 | 40 | 20 | 2.2 |
| Comparative yellow toner No. 4 | 6.9 | 5.5 | 20 | 40 | 22 | 2.5 |
| Comparative yellow toner No. 5 | 7.0 | 5.6 | 21 | 38 | 21 | 3.2 |
| Comparative yellow toner No. 6 | 7.0 | 5.6 | 22 | 38 | 21 | 2.9 |
| Comparative yellow toner No. 7 | 6.8 | 5.4 | 24 | 41 | 20 | 3.0 |
| Comparative yellow toner No. 8 | 6.9 | 5.5 | 21 | 39 | 19 | 2.9 |
| Comparative yellow toner No. 9 | 7.0 | 5.6 | 22 | 38 | 22 | 3.2 |
| Comparative yellow toner No. 10 | 6.9 | 5.5 | 23 | 38 | 21 | 3.3 |
| Comparative yellow toner No. 11 | 6.9 | 5.5 | 20 | 38 | 25 | 4.0 |

TABLE 14

| | | | | | Normal temperature/normal humidity environment | | | | | |
|---|---|---|---|---|---|---|---|---|---|---|
| | | | | | Initial stage | | | After copying 30,000 sheets | | |
| | $G'_{130}$ (dyn/cm$^2$) | $G'_{170}$ (dyn/cm$^2$) | $G'_{170}/G'_{130}$ | $D_{0.5}$ | Image density | Fog-ging | Reproducibility of highlight portion | Image density | Fog-ging | Reproducibility of highlight portion |
| Example No. 10 | $8 \times 10^3$ | $1 \times 10^4$ | 1.25 | 1.45 | 1.85 | A | A | 1.81 | A | A |
| Example No. 11 | $1 \times 10^4$ | $3 \times 10^4$ | 3.00 | 1.43 | 1.83 | A | A | 1.79 | A | A |
| Example No. 12 | $2 \times 10^4$ | $2 \times 10^4$ | 1.00 | 1.42 | 1.82 | A | A | 1.79 | A | A |
| Comparative Example No. 33 | $8 \times 10^3$ | $1 \times 10^4$ | 1.25 | 1.45 | 1.69 | A | A | 1.54 | C | C |
| Comparative Example No. 34 | $8 \times 10^3$ | $1 \times 10^4$ | 1.25 | 1.44 | 1.75 | A | A | 1.66 | B | C |
| Comparative Example No. 35 | $7 \times 10^3$ | $5 \times 10^2$ | 0.07 | 1.45 | 1.85 | B | B | 1.80 | C | C |
| Comparative Example No. 36 | $5 \times 10^4$ | $4 \times 10^4$ | 0.80 | 1.42 | 1.83 | A | A | 1.72 | C | C |

TABLE 14-continued

| | | | | | | | | | | |
|---|---|---|---|---|---|---|---|---|---|---|
| Comparative Example No. 37 | $7 \times 10^4$ | $7 \times 10^3$ | 0.10 | 1.40 | 1.82 | A | A | 1.72 | C | C |
| Comparative Example No. 38 | $2 \times 10^5$ | $6 \times 10^4$ | 0.30 | 1.38 | 1.79 | A | A | 1.71 | C | C |
| Comparative Example No. 39 | $7 \times 10^3$ | $5 \times 10^2$ | 0.07 | 1.44 | 1.82 | B | C | 1.80 | C | C |
| Comparative Example No. 40 | $5 \times 10^4$ | $4 \times 10^4$ | 0.80 | 1.41 | 1.81 | A | B | 1.78 | B | C |
| Comparative Example No. 41 | $7 \times 10^4$ | $7 \times 10^3$ | 0.10 | 1.40 | 1.79 | A | B | 1.76 | B | B |
| Comparative Example No. 42 | $2 \times 10^5$ | $6 \times 10^4$ | 0.07 | 1.37 | 1.75 | A | B | 1.72 | B | B |
| Comparative Example No. 43 | $7 \times 10^3$ | $5 \times 10^2$ | 0.30 | 1.20 | 1.62 | A | A | 1.55 | C | B |

| | | Both surfaces fixation operation | | |
|---|---|---|---|---|
| | Light-permeability of OHP fixing image | Contamination of silicone oil | Occurrence of curl | Photosensitive drum surface appearance after running test |
| Example No. 10 | A | A | A | A |
| Example No. 11 | A | A | A | A |
| Example No. 12 | A | A | A | A |
| Comparative Example No. 33 | A | C | A | C |
| Comparative Example No. 34 | A | C | A | C |
| Comparative Example No. 35 | A | C | C | C |
| Comparative Example No. 36 | B | C | B | B |
| Comparative Example No. 37 | C | C | A | B |
| Comparative Example No. 38 | C | B | A | B |
| Comparative Example No. 39 | B | C | C | C |
| Comparative Example No. 40 | B | C | B | B |
| Comparative Example No. 41 | C | C | A | A |
| Comparative Example No. 42 | C | B | A | A |
| Comparative Example No. 43 | C | B | C | C |

TABLE 15

| | Image quality of full color image | | Contamination of | Occurrence | Translucency of full color image of |
|---|---|---|---|---|---|
| | Surface | Back | silicone oil | of curl | OHP film |
| Example No. 13 | A | A | A | A | A |
| Comparative Example No. 44 | A | C | B | A | C |
| Comparative Example No. 45 | A | C | B | A | C |
| Comparative Example No. 46 | A | C | C | B | C |
| Comparative Example No. 47 | A | C | B | B | C |
| Comparative Example No. 48 | B | C | C | C | C |
| Comparative Example No. 49 | B | B | B | C | B |

Images were assessed by visual observation as compared with a full color original image by the three grades: A (good), B (average), C (bad). Other items were assessed in the same manner as in monocolor mode of Example 1.

What is claimed is:

1. A color toner, comprising (i) color toner particles containing at least a binder resin and a colorant and (ii) an external additive, wherein (a) the color toner has a weight-average particle diameter of 5 to 8 μm and a number-average particle diameter of 4.5 to 7.5 μm, and contains 5 to 40% by number of particles having a particle diameter of 4 μm or less in the number distribution of the color toner and 7% by volume or less of particles having a particle diameter of 10.08 μm or more in the volume distribution of the color toner, (b) an inorganic powder selected from the group consisting of a strontium titanate powder, a cerium oxide powder and a calcium titanate powder, and a hydrophobic fine alumina powder are externally added to the color toner particles as the external additives, the inorganic powder has a longitudinal average particle diameter of 0.2 to 2 μm, and the hydrophobic fine alumina powder has a longitudinal average particle diameter of 0.005 to 0.1 μm, (c) the binder resin is a polyester resin crosslinked by a crosslinking agent, (d) the color toner particles contain 0 to 20 mg/lg of a chloroform insoluble matter, (e) the color toner has a storage modulus ($G'_{130}$) of $2\times10^3$ to $2\times10^4$ [dyn/cm$^2$] at a temperature of 130° C. and a storage modulus ($G'_{170}$) of $5\times10^3$ to $5\times10^4$ [dyn/cm$^2$] at a temperature of 170° C., and a value of $G'_{170}/G'_{130}$ is in the range of 0.25 to 10.

2. The color toner according to claim 1, wherein the color toner particles contain 0 to 15 mg/lg of the chloroform insoluble matter.

3. The color toner according to claim 1, wherein 0.01 to 2 parts by weight of the inorganic powder is externally added to 100 parts by weight of the color toner particles.

4. The color toner according to claim 1, wherein 0.05 to 1 part by weight of the inorganic powder is externally added to 100 parts by weight of the color toner particles.

5. The color toner according to claim 1, wherein 0.5 to 5 parts by weight of the hydrophobic fine alumina powder is externally added to 100 parts by weight of the color toner particles.

6. The color toner according to claim 1, wherein 0.6 to 3 parts by weight of the hydrophobic fine alumina powder is externally added to 100 parts by weight of the color toner particles.

7. The color toner according to claim 1, wherein 0.01 to 2 parts by weight of the inorganic powder is externally added to 100 parts by weight of the color toner particles, and 0.5 to 5 parts by weight of the hydrophobic fine alumina powder is externally added to 100 parts by weight of the color toner particles.

8. The color toner according to claim 1, wherein 0.05 to 1 part by weight of the inorganic powder is externally added to 100 parts by weight of the color toner particles, and 0.6 to 3 parts by weight of the hydrophobic fine alumina powder is externally added to 100 parts by weight of the color toner particles.

9. The color toner according to claim 1, wherein the hydrophobic fine alumina powder has a BET specific surface area of 130 $m^2/g$ or more.

10. The color toner according to claim 1, wherein the hydrophobic fine alumina powder has a BET specific surface area of 150 to 400 $m^2/g$.

11. The color toner according to claim 7, wherein the hydrophobic fine alumina powder has a BET specific surface area of 150 to 400 $m^2/g$.

12. The color toner according to claim 1, wherein the hydrophobic fine alumina powder has a hydrophobic degree of 30 to 90%.

13. The color toner according to claim 1, wherein the hydrophobic fine alumina powder has a hydrophobic degree of 40 to 80%.

14. The color toner according to claim 11, wherein the hydrophobic fine alumina powder has a hydrophobic degree of 30 to 90%.

15. The color toner according to claim 1, wherein the hydrophobic fine alumina powder is obtained by surface treatment with alkyl alkoxy silane.

16. The color toner according to claim 1, wherein the hydrophobic fine alumina powder has a γ type crystalline structure.

17. The color toner according to claim 1, wherein the hydrophobic fine alumina powder has an amorphous structure.

18. The color toner according to claim 1, wherein the value of $G'_{170}/G'_{130}$ of the color toner is in the range of 0.5 to 10.

19. The color toner according to claim 1, wherein the value of $G'_{170}/G'_{130}$ of the color toner is in the range of 1 to 10.

20. The color toner according to claim 1, wherein the color toner has a coloring power by which an image density ($D_{0.5}$) after the color toner is once fixed is usually 1.2 or more when the amount (M/S) of non-fixed color toner on a transfer material is set to 0.5 $mg/cm^2$.

21. The color toner according to claim 1, wherein the color toner has a coloring power by which an image density ($D_{0.5}$) after the color toner is once fixed is usually 1.3 or more when the amount (M/S) of non-fixed color toner on a transfer material is set to 0.5 $mg/cm^2$.

22. The color toner according to claim 1, wherein the color toner has a coloring power by which an image density ($D_{0.5}$) after the color toner is once fixed is usually in the range of 1.2 to 1.8 when the amount (M/S) of non-fixed color toner on a transfer material is set to 0.5 $mg/cm^2$.

23. The color toner according to claim 1, wherein the color toner has a coloring power by which an image density ($D_{0.5}$) after the color toner is once fixed is usually in the range of 1.3 to 1.7 when the amount (M/S) of non-fixed color toner on a transfer material is set to 0.5 $mg/cm^2$.

24. The color toner according to claim 3, wherein the inorganic powder is the strontium titanate powder.

25. The color toner according to claim 3, wherein the inorganic powder is the cerium oxide powder.

26. The color toner according to claim 3, wherein the inorganic powder is the calcium titanate powder.

27. The color toner according to claim 18, wherein the crosslinked polyester resin is generated by condensation polymerization of a monomer containing at least a bivalent alcohol component, a bivalent acid component and a trivalent or more valued carboxylic acid component.

28. The color toner according to claim 27, wherein the crosslinked polyester resin has a glass transition temperature of 50 to 80° C., a number-average molecular weight (Mn) of 1000 to 9000, Mw/Mn of 5.0 or less, and a main-peak molecular weight (Mp) of 5000 to 12000 in the molecular weight distribution of GPC.

29. The color toner according to claim 28, wherein the crosslinked polyester resin contains 0 to 1% by weight of the chloroform insoluble matter (on the basis of a resin).

30. The color toner according to claim 28, wherein the crosslinked polyester resin contains 0 to 0.9% by weight of the chloroform insoluble matter.

31. The color toner according to claim 28, wherein the crosslinked polyester resin contains 0 to 0.5% by weight of the chloroform insoluble matter.

32. The color toner according to claim 1, wherein the color toner is a cyan toner.

33. The color toner according to claim 1, wherein the color toner is a magenta toner.

34. The color toner according to claim 1, wherein the color toner is a yellow toner.

35. An image forming method, comprising the steps of:

(1) electrically charging an electrostatic image carrier, exposing the charged electrostatic image carrier to form an electrostatic image on the electrostatic image carrier, developing the electrostatic image with a developer containing color toner to form a color toner image on the electrostatic image carrier, transferring the color toner image on the electrostatic image carrier onto one surface of a transfer material, and heating, pressurizing and fixing the transferred color toner image on the one surface of the transfer material by heating/pressurizing means, the color toner comprising (i) color toner particles containing at least a binder resin and a colorant and (ii) an external additive, wherein (a) the color toner has a weight-average particle diameter of 5 to 8 μm and a number-average particle diameter of 4.5 to 7.5 μm, and contains 5 to 40% by number of particles having a particle diameter of 4 μm or less in the number distribution of the color toner and 7% by volume or less of particles having a particle diameter of 10.08 μm or more in the volume distribution of the color toner, (b) an inorganic powder selected from the group consisting of a strontium titanate powder, a cerium oxide powder and a calcium titanate powder, and a hydrophobic fine alumina powder are externally added to the color toner particles as the external additive, the inorganic powder has a longitudinal average particle diameter of 0.2 to 2 μm, and the hydrophobic fine alumina powder has a longitudinal average particle diameter of 0.005 to 0.1 μm, (c) the binder resin is a polyester resin crosslinked by a crosslinking agent, (d) the color toner particles contain 0 to 20 mg/lg of a chloroform insoluble matter, (e) the color toner has a storage modulus ($G'_{130}$) of $2\times10^3$ to $2\times10^4$ [$dyn/cm^2$] at a temperature of 130° C. and a storage modulus ($G'_{170}$) of $5\times10^3$ to $5\times10^4$ [$dyn/cm^2$] at a temperature of 170° C., and a value of $G'_{170}/G'_{130}$ is in the range of 0.25 to 10;

(2) cleaning the color toner remaining on the electrostatic image carrier after transferred by cleaning means, electrically charging the cleaned electrostatic image carrier, exposing the charged electrostatic image carrier to form an electrostatic image on the electrostatic image carrier, developing the electrostatic image with a developer containing color toner to form a color toner image on the electrostatic image carrier, transferring the color toner image on the electrostatic image carrier onto the other surface of the transfer material with the color toner image fixed on the one surface, and heating, pressurizing and fixing the transferred color toner image on the other surface of the transfer material by the heating/pressurizing means to form the fixed color toner images on both the surfaces of the transfer material, the color toner comprising (i) color toner particles containing at least a binder resin and a colorant and (ii) an external additive, wherein (a) the color toner has a weight-average particle diameter of 5 to 8 μm and a number-average particle diameter of 4.5 to 7.5 μm, and contains 5 to 40% by number of particles having a particle diameter of 4 μm or less in the number distribution of the color toner and 7% by volume or less of particles having a particle diameter of 10.08 μm or more in the volume distribution of the color toner, (b) an inorganic powder selected from the group consisting of a strontium titanate powder, a cerium oxide powder and a calcium titanate powder, and a hydrophobic fine alumina powder are externally added to the color toner particles as the external additive, the inorganic powder has a longitudinal average particle diameter of 0.2 to 2 μm, and the hydrophobic fine alumina powder has a longitudinal average particle diameter of 0.005 to 0.1 μm, (c) the binder resin is a polyester resin crosslinked by a crosslinking agent, (d) the color toner particles contain 0 to 20 mg/lg of a chloroform insoluble matter, (e) the color toner has a storage modulus ($G'_{130}$) of $2\times10^3$ to $2\times10^4$ [dyn/cm$^2$] at a temperature of 130° C. and a storage modulus ($G'_{170}$) of $5\times10^3$ to $5\times10^4$ [dyn/cm$^2$] at a temperature of 170° C., and a value of $G'_{170}/G'_{130}$ is in the range of 0.25 to 10.

36. The image forming method according to claim 35, wherein the color toner is a cyan toner.

37. The image forming method according to claim 35, wherein the color toner is a magenta toner.

38. The image forming method according to claim 35, wherein the color toner is a yellow toner.

39. The image forming method according to claim 35, wherein (1-1) the electrostatic image carrier is electrically charged, the charged electrostatic image carrier is exposed to from the electrostatic image on the electrostatic image carrier, the electrostatic image is developed with a first color toner selected from the group consisting of a cyan toner, a magenta toner and a yellow toner, a first color toner image on the electrostatic image carrier is transferred to one surface of the transfer material carried by the transfer drum, the first color toner remaining on the electrostatic image carrier after transferred is cleaned by the cleaning means, (1-2) the cleaned electrostatic image carrier is electrically charged, the charged electrostatic image carrier is exposed to form the electrostatic image on the electrostatic image carrier, the electrostatic image is developed with a second color toner selected from the group consisting of the cyan toner, the magenta toner and the yellow toner, a second color toner image on the electrostatic image carrier is transferred to the one surface of the transfer material carried by the transfer drum, the second color toner remaining on the electrostatic image carrier after transferred is cleaned by the cleaning means, (1-3) the cleaned electrostatic image carrier is electrically charged, the charged electrostatic image carrier is exposed to form the electrostatic image on the electrostatic image carrier, the electrostatic image is developed with a third color toner selected from the group consisting of the cyan toner, the magenta toner and the yellow toner, a third color toner image on the electrostatic image carrier is transferred to the one surface of the transfer material carried by the transfer drum, the third color toner remaining on the electrostatic image carrier after transferred is cleaned by the cleaning means, (1-4) the cyan toner, the magenta toner and the yellow toner satisfy said (a), (b), (c), (d) and (e), (1-5) the first, second and third color toner images transferred onto the transfer material are heated, pressurized and fixed on the one surface of the transfer material by the heating/pressurizing means to form a full color image, (2-1) the cleaned electrostatic image carrier is electrically charged, the charged electrostatic image carrier is exposed to from the electrostatic image on the electrostatic image carrier, the electrostatic image is developed with the first color toner selected from the group consisting of the cyan toner, the magenta toner and the yellow toner, the first color toner image on the electrostatic image carrier is transferred to the other surface of the transfer material with the full color image on the one surface carried by the transfer drum, the first color toner remaining on the electrostatic image carrier after transferred is cleaned by the cleaning means, (2-2) the cleaned electrostatic image carrier is electrically charged, the charged electrostatic image carrier is exposed to form the electrostatic image on the electrostatic image carrier, the electrostatic image is developed with the second color toner selected from the group consisting of the cyan toner, the magenta toner and the yellow toner, the second color toner image on the electrostatic image carrier is transferred to the other surface of the transfer material carried by the transfer drum, the second color toner remaining on the electrostatic image carrier after transferred is cleaned by the cleaning means, (2-3) the cleaned electrostatic image carrier is electrically charged, the charged electrostatic image carrier is exposed to form the electrostatic image on the electrostatic image carrier, the electrostatic image is developed with the third color toner selected from the group consisting of the cyan toner, the magenta toner and the yellow toner, the third color toner image on the electrostatic image carrier is transferred to the other surface of the transfer material carried by the transfer drum, the third color toner remaining on the electrostatic image carrier after transferred is cleaned by the cleaning means, (2-4) the cyan toner, the magenta toner and the yellow toner satisfy said (a), (b), (c), (d) and (e), (2-5) the first, second and third color toner images transferred onto the other surface of the transfer material are heated, pressurized and fixed on the other surface of the transfer material by the heating/pressurizing means to form another full color image on the other surface.

40. The image forming method according to claim 39, wherein the heating/pressurizing means has means for applying silicone oil.

41. The image forming method according to claim 39, wherein the heating/pressurizing means has a fixing roller incorporating heating means and a pressurizing roller, and silicone oil is applied to the fixing roller.

42. The image forming method according to claim 35, wherein the color toner is the color toner claimed in any one of claims 2 to 34.

43. An image forming method, comprising the steps of:

(1) electrically charging an electrostatic image carrier, exposing the charged electrostatic image carrier to form an electrostatic image on the electrostatic image carrier, developing the electrostatic image with a developer containing color toner to form a color toner image on the electrostatic image carrier, transferring the color toner image on the electrostatic image carrier onto one surface of a transfer material, and heating, pressurizing and fixing the transferred color toner image on the one surface of the transfer material by heating/pressurizing means, the color toner comprising (i) color toner particles containing at least a binder resin and a colorant and (ii) an external additive, wherein (a) the color toner has a weight-average particle diameter of 5 to 8 μm and a number-average particle diameter of 4.5 to 7.5 μm, and contains 5 to 40% by number of particles having a particle diameter of 4 μm or less in the number distribution of the color toner and 7% by volume or less of particles having a particle diameter of 10.08 μm or more in the volume distribution of the color toner, (b) an inorganic powder selected from the group consisting of a strontium titanate powder, a cerium oxide powder and a calcium titanate powder, and a hydrophobic fine alumina powder are externally added to the color toner particles as the external additive, the inorganic powder has a longitudinal average particle diameter of 0.2 to 2 μm, and the hydrophobic fine alumina powder has a longitudinal average particle diameter of 0.005 to 0.1 μm, (c) the binder resin is a polyester resin crosslinked by a crosslinking agent, (d) the color toner particles contain 0 to 20 mg/lg of a chloroform insoluble matter, (e) the color toner has a storage modulus ($G'_{130}$) of $2\times10^3$ to $2\times10^4$ [dyn/cm$^2$] at a temperature of 130° C. and a storage modulus ($G'_{170}$) of $5\times10^3$ to $5\times10^4$ [dyn/cm$^2$] at a temperature of 170°, and a value of $G'_{170}/G'_{130}$ is in the range of 0.25 to 10;

(2) cleaning the color toner remaining on the electrostatic image carrier after transferred by cleaning means, electrically charging the cleaned electrostatic image carrier, exposing the charged electrostatic image carrier to form an electrostatic image on the electrostatic image carrier, developing the electrostatic image with a developer containing color toner to form a color toner image on the electrostatic image carrier, transferring the color toner image on the electrostatic image carrier onto the other surface of the transfer material with the color toner image fixed on the one surface, and heating, pressurizing and fixing the transferred color toner image on the other surface of the transfer material by the heating/pressurizing means to form the fixed color toner images on both the surfaces of the transfer material, the color toner comprising (i) color toner particles containing at least a binder resin and a colorant and (ii) an external additive, wherein (a) the color toner has a weight-average particle diameter of 5 to 8 μm and a number-average particle diameter of 4.5 to 7.5 μm, and contains 5 to 40% by number of particles having a particle diameter of 4 μm or less in the number distribution of the color toner and 7% by volume or less of particles having a particle diameter of 10.08 μm or more in the volume distribution of the color toner, (b) an inorganic powder selected from the group consisting of a strontium titanate powder, a cerium oxide powder and a calcium titanate powder, and a hydrophobic fine alumina powder are externally added to the color toner particles as the external additive, the inorganic powder has a longitudinal average particle diameter of 0.2 to 2 μm, and the hydrophobic fine alumina powder has a longitudinal average particle diameter of 0.005 to 0.1 μm, (c) the binder resin is a polyester resin crosslinked by a crosslinking agent, (d) the color toner particles contain 0 to 20 mg/lg of a chloroform insoluble matter, (e) the color toner has a storage modulus ($G'_{130}$) of $2\times10^3$ to $2\times10^4$ [dyn/cm$^2$] at a temperature of 130° C. and a storage modulus ($G'_{170}$) of $5\times10^3$ to $5\times10^4$ [dyn/cm$^2$] at a temperature of 170°, and a value of $G'_{170}/G'_{130}$ is in the range of 0.25 to 10, wherein (1-1) the electrostatic image carrier is electrically charged, the charged electrostatic image carrier is exposed to form the electrostatic image on the electrostatic image carrier, the electrostatic image is developed with a first color toner selected from the group consisting of a cyan toner, a magenta toner and a yellow toner, a first color toner image on the electrostatic image carrier is transferred to one surface of the transfer material carried by the transfer drum, the first color toner remaining on the electrostatic image carrier after transferred is cleaned by the cleaning means, (1-2) the cleaned electrostatic image carrier is electrically charged, the charged electrostatic image carrier is exposed to form the electrostatic image on the electrostatic image carrier, the electrostatic image is developed with a second color toner selected from the group consisting of the cyan toner, the magenta toner and the yellow toner, a second color toner image on the electrostatic image carrier is transferred to the one surface of the transfer material carried by the transfer drum, the second color toner remaining on the electrostatic image carrier after transferred is cleaned by the cleaning means, (1-3) the cleaned electrostatic image carrier is electrically charged, the charged electrostatic image carrier is exposed to form the electrostatic image on the electrostatic image carrier, the electrostatic image is developed with a third color toner selected from the group consisting of the cyan toner, the magenta toner and the yellow toner, a third color toner image on the electrostatic image carrier is transferred to the one surface of the transfer material carried by the transfer drum, the third color toner remaining on the electrostatic image carrier after transferred is cleaned by the cleaning means, (1-4) the cyan toner, the magenta toner and the yellow toner satisfy said (a), (b), (c), (d) and (e), (1-5) the first, second and third color toner images transferred onto the transfer material are heated, pressurized and fixed on the one surface of the transfer material by the heating/pressurizing means to form a full color image, (2-1) the cleaned electrostatic image carrier is electrically charged, the charged electrostatic image carrier is exposed to form the electrostatic image on the electrostatic image carrier, the electrostatic image is developed with the first color toner selected from the group consisting of the cyan toner, the magenta toner and the yellow toner, the first color toner image on the electrostatic image carrier is transferred to the other surface of the transfer material with the full color image on the one surface carried by the transfer drum, the first color toner remaining on the electrostatic image carrier after transferred is cleaned by the cleaning means, (2-2) the cleaned electrostatic image carrier is electrically charged, the charged electrostatic image carrier is exposed to form the electrostatic image on the electrostatic image carrier, the electrostatic image is developed with the second color toner selected from the group consisting of the cyan toner, the magenta toner and the yellow toner, the second color toner image on the electrostatic image carrier is transferred to the other surface of the transfer material carried by the transfer drum, the second color toner remaining on the electrostatic image carrier after transferred is cleaned by the cleaning means, (2-3) the cleaned electrostatic image carrier is electrically charged, the charged electrostatic image carrier is exposed to form the electrostatic image on the electrostatic image carrier, the electrostatic image is developed with the third color toner selected from the group consisting of the cyan toner, the magenta toner and the yellow toner, the third color toner image on the electrostatic image carrier is transferred to the other surface of the transfer material carried by the transfer drum, the third color toner remaining on the electrostatic image carrier after transferred is cleaned by the cleaning means, (2-4) the cyan toner, the magenta toner and the yellow toner satisfy said (a), (b), (c), (d) and (e), (2-5) the first, second and third color toner images transferred onto the other surface of the transfer material are heated, pressurized and fixed on the other surface of the transfer material by the heating/pressurizing means to form another full color image on the other surface, and the cyan toner, the magenta toner, and the yellow toner of claims 2 to 34.

* * * * *

UNITED STATES PATENT AND TRADEMARK OFFICE

CERTIFICATE OF CORRECTION

PATENT NO. : 6,013,402

DATED : January 11, 2000

INVENTOR(S) : MAKOTO KANBAYASHI, ET AL.

It is certified that error appears in the above-identified patent and that said Letters Patent is hereby corrected as shown below:

COLUMN 1
Line 37, "using," should read --using--;
Line 45, ""allows" should read --allowing;
Line 50, "is" should be deleted;
Line 54, "in" (1st occurrence) should be deleted.

COLUMN 2
Line 44, "A" should read --a--;
Line 61, "frequencies" should read --frequently--.

COLUMN 4
Line 14, "transferred" should read --being transferred--.

COLUMN 5
Line 18, "realize" should read --realizing--;
Line 20, "studies on" should read --studied--;
Line 35, "weighticle" should read --weighted--;
Line 36, "has" should read --have-- and, "few number" should read --fewer numbers--;
Line 45, "weighticle" should read --weighted--;
Line 54, "increases" should read --increase--;
Line 56, "reducing" should read --we considered reducing--;
Line 58, "weighticle" should read --weighted--;
Line 67, "is" should read --are--.

COLUMN 6
Line 8, "particle" (1st occurrence) should read --particles--;
Line 56, "little" should read --small--
Line 67, "lower" should read --lower.--.

COLUMN 7
Line 4, "tuginal" should read --tudinal--;
Line 32, "on" should be deleted;
Line 43, "underwent" should read --undergoing--.

COLUMN 9
Line 20, "distinct than" should read --distinct from--;
Line 45, "hydrolyze" should read --hydrolyzing--;
Line 54, "parts" should read --part--;

UNITED STATES PATENT AND TRADEMARK OFFICE

CERTIFICATE OF CORRECTION

PATENT NO. : 6,013,402

DATED : January 11, 2000

INVENTOR(S) : MAKOTO KANBAYASHI, ET AL.

It is certified that error appears in the above-identified patent and that said Letters Patent is hereby corrected as shown below:

Line 55, "a parts" should read --parts--;
Line 56, "is" should read --are--;
Line 63, "generate" should read --generates--.

COLUMN 10
Line 51, "telephthalic" should read --terephthalic--;
Line 53, "non linearly" should read --non-linearly--.

COLUMN 12
Line 17, "very" should read --substantially--;
Line 39, "remained" should read --remaining--;
Line 64, "to" should be deleted.

COLUMN 13
Line 46, "flexuous" should read --flexible--.

COLUMN 15
Line 11, "few" should read --small--;
Line 64, "The" should read --the--.

COLUMN 17
Line 14, "no" should be deleted.

COLUMN 19
Line 19, "Furanhofer" should read --Fraunhofer--.

COLUMN 22
Line 38, "develope" should read --develop--.

COLUMN 25
Line 2, "10 b," should read --10b,--
Line 5, "10 a" should read --10a-- and "10 b" should read -- 10b--;
Line 7, "10 b" should read -- 10b--.

COLUMN 26
Line 19, "31" should read --31--.

COLUMN 33
Line 14, "bright." should read --brightness.--.

UNITED STATES PATENT AND TRADEMARK OFFICE

CERTIFICATE OF CORRECTION

PATENT NO. : 6,013,402

DATED : January 11, 2000

INVENTOR(S) : MAKOTO KANBAYASHI, ET AL.

It is certified that error appears in the above-identified patent and that said Letters Patent is hereby corrected as shown below:

COLUMN 56
Line 60, "transferred" should read --transfers.

COLUMN 57

Line 45, "from" should read --form--;
Line 52, "transferred" should read --transfer--;
Line 64, "transferred" should read --transfer--.

COLUMN 58
Line 8, "transferred" should read --transfer--;
Line 19, "from" should read --form--;
Line 28, "transferred" should read --transfer--;
Line 39, "transferred" should read --transfer--;
Line 52, "transferred" should read --transfer--.

COLUMN 59
Line 45, "transferred" should read --transfer--.

COLUMN 60
Line 31, "transferred" should read --transfer--;
Line 44, "transferred" should read --transfer--.

COLUMN 61
Line 11, "transferred" should read --transfer--;
Line 24, "transferred" should read --transfer--.

UNITED STATES PATENT AND TRADEMARK OFFICE

CERTIFICATE OF CORRECTION

PATENT NO. : 6,013,402

DATED : January 11, 2000

INVENTOR(S) : MAKOTO KANBAYASHI, ET AL.

It is certified that error appears in the above-identified patent and that said Letters Patent is hereby corrected as shown below:

COLUMN 62

Line 12, "transferred" should read --transfer--.

Signed and Sealed this

Tenth Day of April, 2001

Nicholas P. Godici

*Attest:*

NICHOLAS P. GODICI

*Attesting Officer*

*Acting Director of the United States Patent and Trademark Office*